US005398741A

United States Patent [19]

Narita et al.

[11] Patent Number: 5,398,741

[45] Date of Patent: Mar. 21, 1995

[54] METHOD AND APPARATUS FOR ROTARY-CUTTING A TIMBER IN A VENEER LATHE

[75] Inventors: Mitsumasa Narita, Tokai; Isao Kondo, Toyoake; Kenji Banno; Eizo Shibata, both of Nagoya; Shinji Kamiya, Kariya; Osamu Naito, Komaki, all of Japan

[73] Assignee: Kabushiki Kaisha Taihei Seisakusho, Komaki, Japan

[21] Appl. No.: 124,288

[22] Filed: Sep. 20, 1993

[30] Foreign Application Priority Data

Sep. 29, 1992 [JP] Japan ..... 4-285271

[51] Int. Cl.[6] ..... B27B 1/00

[52] U.S. Cl. ..... 144/357; 82/118; 82/129; 91/167 R; 91/519; 144/209 R; 144/365; 364/474.07

[58] Field of Search ..... 82/148, 165, 129, 118; 144/209 R, 209 A, 356, 357, 365; 364/474.02, 474.07; 91/167 R, 169, 420, 819, 530

[56] References Cited

U.S. PATENT DOCUMENTS

| | | | |
|---|---|---|---|
| 3,044,511 | 7/1962 | Wieckman et al. | 144/209 R |
| 3,052,272 | 9/1962 | Yock | 144/209 R |
| 3,073,363 | 1/1963 | Lofstedt | 144/209 R |
| 3,132,673 | 5/1964 | Bamford . | |
| 3,139,004 | 6/1964 | Haumann | 144/209 R |
| 3,198,226 | 8/1965 | Haumann | 144/209 R |
| 3,221,787 | 12/1965 | Hitt | 144/209 R |
| 3,672,416 | 6/1972 | Reed | 144/209 R |
| 5,018,561 | 5/1991 | Shimosaka et al. | 144/209 R |

*Primary Examiner*—W. Donald Bray
*Attorney, Agent, or Firm*—Ladas & Parry

[57] ABSTRACT

A method and apparatus for rotary-cutting a timber to peel off a veneer by a cutting knife from the outer periphery of a timber while rotating the timber around its longitudinal axis. The timber is gripped at its two end faces by means of chucking pawls which are driven in rotation. The chucking pawls comprise a plurality of chucks which are different in radial position. The chucks grip the timber at the end faces thereof adjacent to the outer peripheral surface of the timber, and as the timber is cut by the knife and reduced in diameter so that the knife comes close to a presently outermost chuck, the outermost chuck is retracted axially away from the end face of the timber, and the next outermost chuck continues to grip the timber adjacent to the presently outer peripheral surface of the timber. For this reason, the gripping force by the chuck pawls, resisting the cutting force moment, can be made small, and the timber gripping is made reliable.

32 Claims, 23 Drawing Sheets

METHOD AND APPARATUS FOR ROTARY-CUTTING A TIMBER IN A VENEER LATHE

BACKGROUND OF THE INVENTION

1. Field of the Invention

The present invention relates to an efficient gripping of opposite end surfaces of a log or timber in a veneer lathe, and more particularly to a method and apparatus for rotary-cutting a timber in a veneer lathe in which when the timber is cut, end faces of the timber close to the outer peripheral surface thereof to be rotary-cut are gripped, and the part to be gripped is changed stepwise as the diameter of the timber reduces so as to enable effective cutting.

2. Related Art

The veneer lathe is a machine wherein a log or timber is rotated about its longitudinal axis while a knife is applied to the outer peripheral surface thereof to rotary-cut the timber so that a veneer of uniform thickness is continuously peeled off from the outer peripheral surface. As will be described in more detail, the veneer lathe has two types, namely, a center drive type which grips and rotates opposite end faces of a timber, and an outer periphery drive type in which a rotational drive roll having thrust-protrusions is arranged above a knife for cutting the timber to transmit drive of the drive roll to the outer peripheral surface of the timber.

The veneer lathe of the center drive type is preferred to the veneer lathe of the outer periphery drive type because the peripheral surface of the timber is not damaged due to its rotational drive, as will be described later. In the veneer lathe of the center drive type, pawls of chucks bite into opposite end faces of the timber to rotatably grip the timber. During the cutting of the timber, a cutting resistance force acts in a peripheral direction of the timber as the outer peripheral surface thereof is rotary-cut by a knife. It is thus necessary to rotate and drive the timber during the cutting against a cutting moment which is the product of the aforesaid cutting resistance force and the radius of the timber.

However, since the diameter of the timber is large particularly at the outset of the cutting, the cutting moment is also large. The pawls of the chucks need to impart to the timber a resisting moment enough to overcome such a large cutting moment. However, since the radius of the pawls of the chucks, as measured from the center axis of the timber, is relatively small, it is required that an extremely large resistance force be generated in the pawls of the chucks in order to generate a large resisting moment. However how strong the pawls may be, the end faces of the timber into which the pawls bite sometimes cannot withstand a large resistance force, thus resulting in a breakage.

SUMMARY OF THE INVENTION

The present invention is proposed in order to solve the problems as noted above. It is an object of the present invention to provide a method and apparatus for rotary-cutting a log or timber in a veneer lathe, wherein even when a large cutting resisting moment acts on the timber as encountered at the outset of the cutting, the end faces of the timber can withstand it and are not broken, thus providing a good efficiency of the cutting operation and being free from damage of the timber.

According to an aspect of the present invention, there is provided a method for rotary-cutting a timber in a veneer lathe, comprising the steps of: providing a pair of first and second opposite chucking pawl means which are in a confronting relationship with respect to an axis of rotation of the timber; loading the timber into the veneer lathe; moving the first and second chucking pawl means toward each other to cause the pawl means to bite into opposite end faces of the timber so as to grip the timber between the opposite chucking pawl means and on the axis of rotation; driving the opposite chucking pawl means in rotation so as to rotate the timber around the axis of rotation; and advancing a cutting knife extending along the axis of rotation against the timber being rotated to rotary-cut the timber so as to peel off a veneer from an outer peripheral portion of the timber; the method further comprising the steps of: providing each of the first and second chucking pawl means with a plurality of chucks with pawls, said chucks including at least a radially outermost chuck and a radially innermost chuck which are axially displaceable independently from each other; at the start of the rotary-cutting operation, gripping the timber by the opposite chucking pawl means with the outermost chuck of each pawl means gripping the timber at positions adjacent to the outer peripheral surface thereof; as the cutting knife advances to a radial position of the timber close to the radially outer periphery of the outermost chuck, retracting the outermost chuck away from the related end face of the timber with a radially inner second outermost chuck gripping the timber; as the cutting knife further advances to a radial position of the timber close to the radially outer periphery of the second outermost chuck, retracting the second outermost chuck away from the related end face of the timber; and repeating the cutting operation in the same way as above until the cutting knife advances to a radial position of the timber close to the radially outer periphery of the innermost chuck.

According to another aspect of the present invention, there is provided an apparatus for rotary-cutting a timber comprising: a pair of first and second opposite chucking pawl means which are in a confronting relationship with respect to an axis of rotation of the timber; means for moving the first and second chucking means toward each other to grip therebetween the timber on said axis of rotation and away from each other to release the gripped timber; means for rotating the first and second chucking means to rotate the timber gripped between the chucking means around the axis of rotation; cutting knife means for cutting the timber being rotated; and means for advancing the knife means against the timber being rotated to rotary-cut the timber so as to peel off a veneer from an outer peripheral portion of the timber; the apparatus further comprising: a plurality of concentrically disposed chucks with pawls, constituting each of said first and second chucking means, said chucks including at least a radially outermost chuck and a radially innermost chuck which are axially displaceable independently from each other; means connected to the chucks, respectively, for displacing the chucks to and away from the timber independently; and means for operating the displacing means to retract the related chuck away from the timber when the knife means advances to a radial position of the timber close to the outer periphery of the related chuck.

Preferred embodiments of the present invention will be understood from the following detailed description made with reference to the accompanying drawings.

DESCRIPTION OF THE PREFERRED EMBODIMENTS

Before proceeding with a description of preferred embodiments of the present invention, two types of veneer lathes will first be described for a better understanding of the problems in the present invention. These two types include a center drive type which grips and rotates opposite end faces of a timber, and an outer periphery drive type in which a rotational drive roll having thrust-protrusions is arranged above a knife for cutting a log or timber to transmit drive of the drive roll to the outer peripheral portion of the timber.

Figure 26:
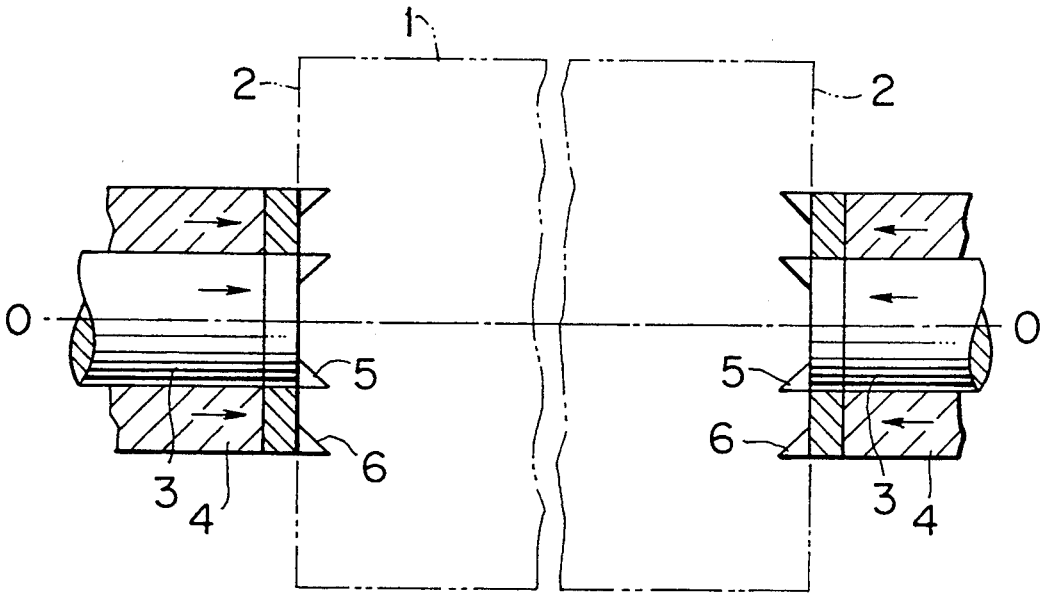
FIG. 26 PRIOR ART
FIG. 26 is an explanatory view of a conventional method for gripping a timber according to a center drive type.

In the former center drive type, as shown in FIG. 26, there are provided a pair of coaxial spindles 3 and 4 having a small diameter and a large diameter, respectively, which can be extended and retracted in the direction of a rotational axis 0—0 relative to end faces 2 at opposite ends of a timber 1. These spindles 3 and 4 are rotatable about the axis 0—0 and are disposed on the opposite ends of the timber 1. Chucking pawls 5 and 6 are fixed on the extreme ends of the spindles 3 and 4, and these pawls 3 and 4 are pressed and bite into the end faces 2 at opposite ends of the timber 1 so that the timber 1 is gripped. With this, the rotation of the spindles causes the timber 1 to be rotatably driven about the axis 0—0.

The diameter of the larger chucking pawls 6 is normally set to be about 220 to about 250 mm, and the diameter of the smaller chucking pawls 5 is normally set to be about 80 to about 120 mm. In rotating and cutting the timber 1 by means of a cutting blade or knife, the smaller spindles 3 arranged on the opposite sides of the timber 1 are moved forward by fluid pressure or the like so that the end faces 2 at the opposite ends of the timber 1 are first pressed and gripped by the smaller chucking pawls 5, and the larger chucking pawls 6 are then moved forward to grip the timber 1 by means of both the larger and smaller chucks 5 and 6 to rotate the timber 1 in a direction as indicated by arrow A in FIG. 27.

Subsequently, a knife head (not shown) is moved forward by a predetermined amount so that a veneer 8 is cut by a cutting knife C (see FIG. 27) on the knife head in a manner to peel off a peripheral surface portion of the timber 1. When the diameter of the timber 1 reaches about 230 to about 260 mm as it is cut, the larger spindles 4 are slidingly retracted so as to axially move away from the timber. Shortly before the diameter of the timber 1 comes near the diameter of the smaller chucking pawls 5, for example, and immediately before the diameter of the timber 1 reaches about 90 to about 130 mm, the cutting is completed, after which the smaller spindles 3 are retracted to discharge the remaining timber core.

Figure 28:
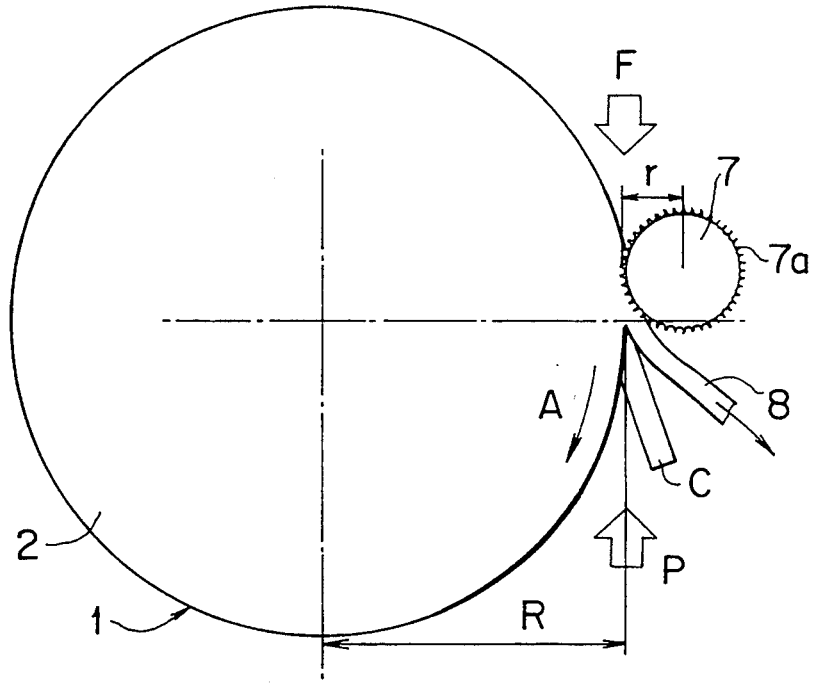
FIG. 28 PRIOR ART
FIG. 28 is an explanatory view of a conventional method according to an outer periphery drive type.

In the latter outer periphery drive type, as shown in FIG. 28, there are provided rotational rolls 7 having a number of axial thrust-protrusions 7*a* which are formed substantially parallel to the edge line of the knife C for cutting the timber 1. The rolls 7 are positioned in a line on the outer peripheral portion of the timber 1 upstream in the rotational direction of the timber and close to the edge of the knife C. the rolls 7 are disposed at a position capable of simultaneously thrusting both the outer peripheral portion of the timber and a veneer 8 which is immediately after being peeled off and cut. In this case, it is also possible to use, in combination, the spindles (as previously mentioned) for gripping and rotating the end faces 2 at the opposite ends of the timber 1.

In rotating and cutting the timber 1, pressure members are placed in the spacings between adjoining rotational rolls 7, which pressure members are pressed against portions upstream, in the rotating direction of the outer periphery of the timber, of the edge of the knife. Thus, power necessary for cutting the timber is supplied to the outer peripheral portion of the timber while preventing breakage of the peeled off portion of the timber and a veneer 8 is produced.

In the former center drive type, however, even if a timber 1 is used having the same kind and the same property, the larger the diameter of the timber 1, the diameter of the larger chucking pawl 6 becomes small relative to the timber diameter, when the timber 1 is gripped and rotated. Therefore, the end faces of the timber 1 cannot withstand the force applied to the chucking pawls, thus giving rise to inconvenience during cutting the timber 1.

Figure 27:
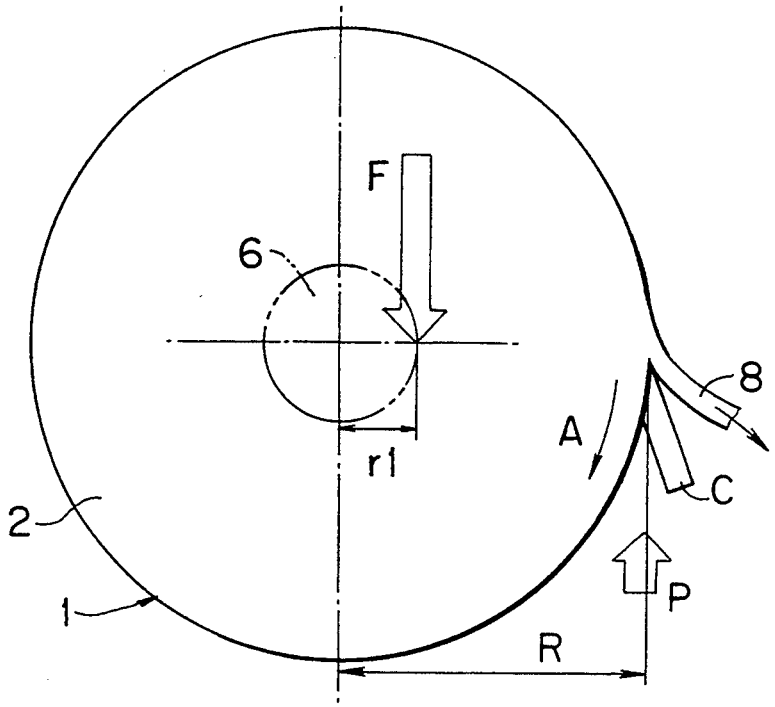
FIG. 27 PRIOR ART
FIG. 27 is a schematic view explanatory of a gripping force of a pawl and a cutting resistance according to a center drive type.

FIG. 27 is a schematic view showing a relationship between a gripping force F and a cutting resistance force P, which are required for cutting the timber 1, in a case where the above described larger chucking pawls 6 are used. In FIG. 27, the product of the gripping force F and the radius r1 of the larger chucking pawls 6 for gripping the opposite end faces 2 of the timber 1 is equal to the product of the cutting resistance force P and the radius R which is the distance from the center portion of the timber 1 to the outer peripheral portion thereof to be cut. This is represented by the following equation.

$$F \times r1 = R \times P.$$

Actual numerical values are applied to the above-described equation. Then, in a case where the diameter of the timber 1 is relatively small, such as 500 mm, and the diameter of the larger chucking pawls 6 is 250 mm, the relationship of F=2P exists. It will be noted that at the outset of cutting the timber 1, the force F to be applied to the chucking pawls 6 is twice the value of the cutting resistance force P.

Figure 29:
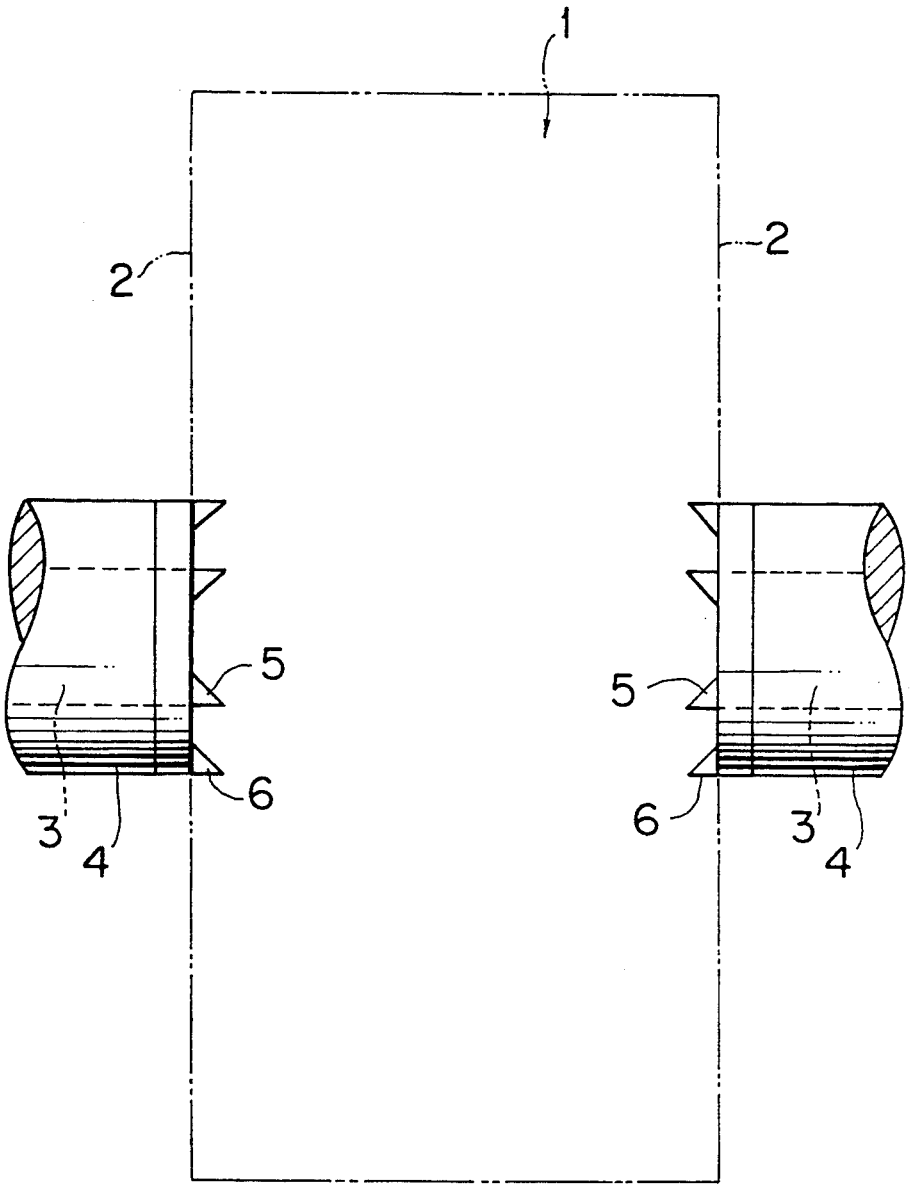
FIG. 29 PRIOR ART
FIG. 29 is an explanatory view of a conventional method for gripping a timber according to the center drive type.

As shown in FIG. 29, if the diameter of the timber 1 is set to be relatively large, such as 100 mm, and the diameter of the larger chucking pawls 6 set to be similar to that described above, a relationship of F=4P exists. Thus, the force F is to be applied which is twice the value of that applied to the end faces 2 of the timber 1 in the former example. As a result, cracks, breakages, etc. tend to often occur in the end faces 2 due to the force applied to the pawls. Because of this, the timber 1 cannot withstand the cutting resistance force acting thereon, failing to sufficiently transmit rotation of the spindles 3 and 4 to the timber 1.

Figure 30:
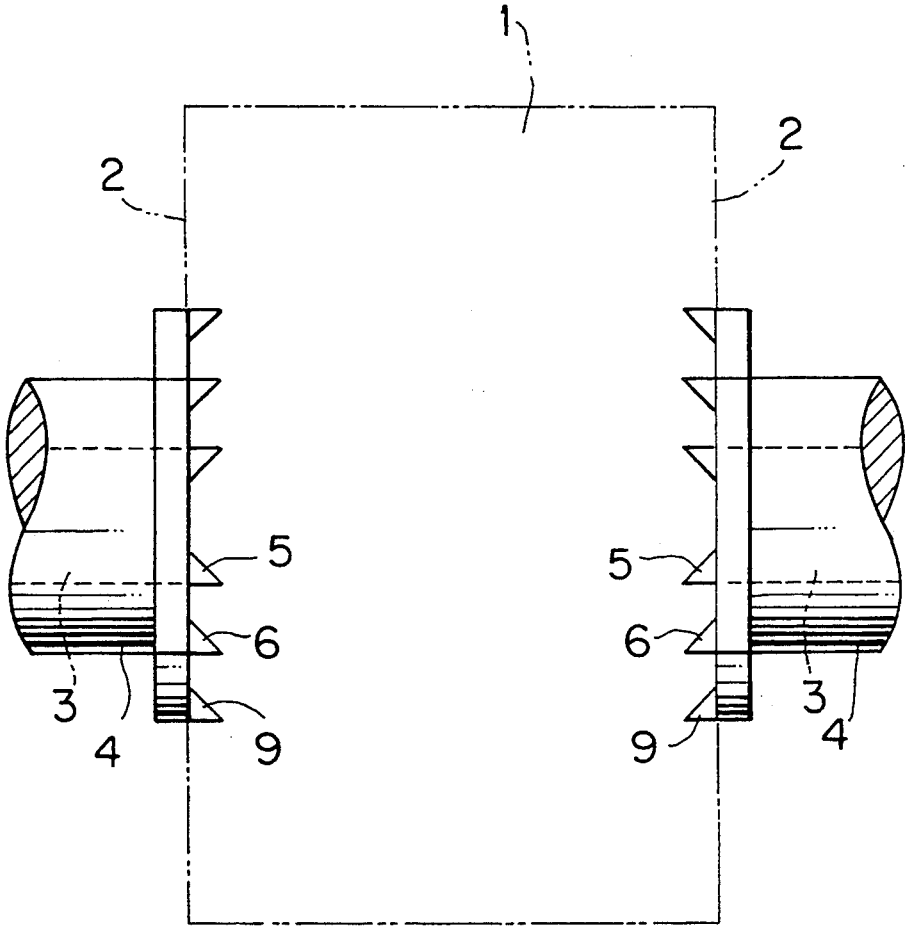
FIG. 30 PRIOR ART
FIG. 30 is an explanatory view of a further conventional method for gripping a timber according to the center drive type.

Accordingly, in an attempt to reduce the difference between the diameter of the timber and the diameter of the larger chucking pawls as the diameter of the timber 1 increases, proposals have been made to provide a method of further increasing the diameter of the larger chucking pawls 6 or a method of fitting around the larger chuck 6 an auxiliary chuck 9 (FIG. 30), which has a further larger diameter than that of the large chuck 6. However, in the former case, the difference in diameter between the smaller chuck 5 and the larger chuck 6 increases, resulting in occurrence of a problem similar to that as described above when the timber is changed in its gripping mode from the larger chuck 6 to the small chuck 5. On the other hand, in the latter case, if an equation similar to that as described above is considered with the diameter of the auxiliary chuck 9 being r2, then a problem still remains. When the auxiliary chuck 9 is used, a relationship of $F \times r2 = R \times P$ is obtained. Actual numerical values are applied to this equation. Then, even in a case where the diameter of the timber 1 is set to 1000 mm, and the diameter of the auxiliary chuck 9 set to 350 mm, a relationship of F=2.85P is obtained. At the outset of cutting the timber 1, the exerting force F is decreased as compared with the case where only the larger chuck 6 are used, but the force F about three times the value of that of the cutting resistance force is still applied thereto.

Moreover, the auxiliary chuck 9 is merely fitted around the larger chuck 6. Therefore, the axial retracting movement of the auxiliary chuck 9 during the cutting of the timber 1 to release the gripping of the auxiliary chuck 9 must be accomplished by once stopping the rotation of the spindles and then releasing the fitting engagement between the auxiliary chuck 9 and the larger chuck 6. This lowers the working efficiency. In addition, when the auxiliary chuck 9 is retracted, the timber 1 is once released from its gripping by both the larger and smaller chucks 5 and 6, thus lowering the working efficiency. Furthermore, when the timber 1 is again gripped by the chucks 5 and 6, deviation from correct gripping position tends to occur, thus lowering the yield of timbers.

According to the outer periphery drive type, as compared with the center drive type, the rotational rolls 7 are positioned at the outer peripheral portion, upstream in the rotating direction of the timber 1, close to the edge of the knife C and are capable of simultaneously thrusting both the outer peripheral portion of the timber 1 and a veneer 8 immediately after being cut. Accordingly, an equation of approximately F=P holds. The force F required to cut the timber 1 will suffice to be the force resisting the cutting resistance force P. Thus the veneer 8 can be cut with a minimum breakage of the timber. However, a number of stripes of thrust-marks impressed by the thrust-protrusions 7*a* on the rotational rolls 7 remain on the surface of the cut veneer 8 in a direction perpendicular to the direction of fibers. Thus, the veneer 8 cannot be used as final products, particularly, as a surface material such as a plywood, LVL, etc.

The above-described problems encountered in the prior art are solved by the present invention which will be described below. In the ensuing description, parts already described above are indicated by the same or like reference numerals as those used previously, and a repeated description will not be made. First, a first embodiment of the present invention will be described in conjunction with FIGS. 1 to 5.

Figure 1:
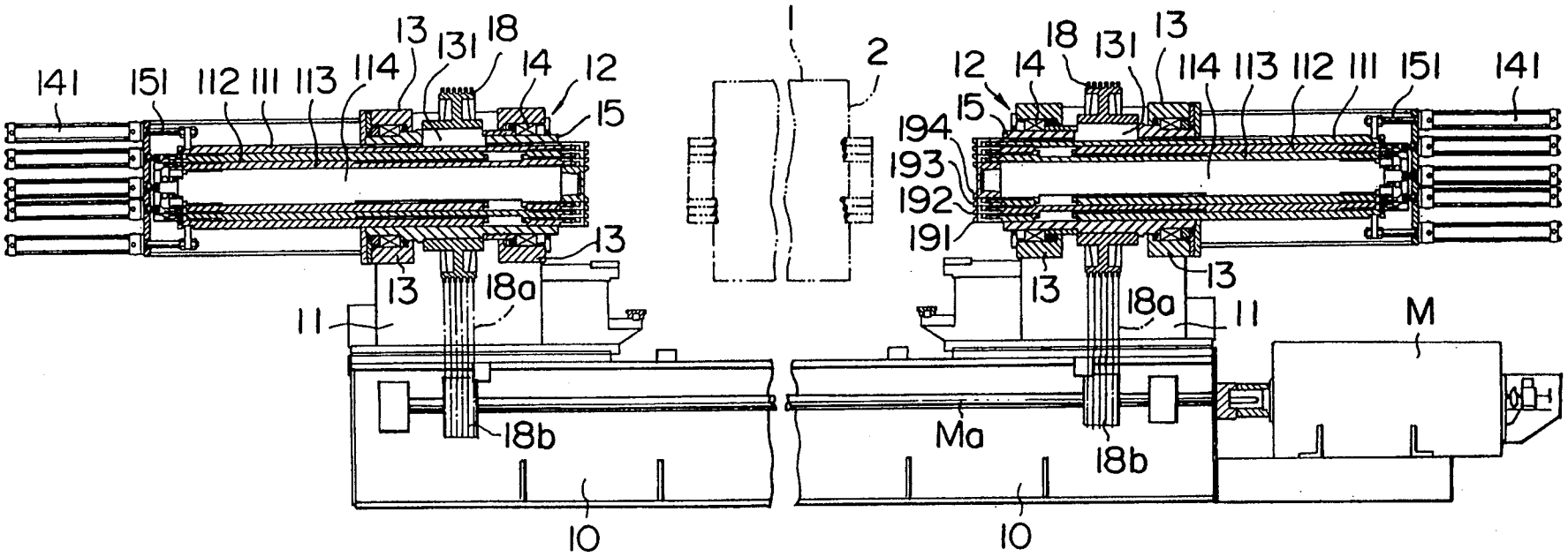
FIG. 1 is a partially cutaway front view illustrating a first embodiment of a timber cutting apparatus according to the present invention.

As shown in FIG. 1, a pair of frames 11 are mounted in a manner spaced apart in a longitudinal direction on an elongated bed 10. Each frame 11 supports thereon a housing 12, which is provided with a pair of spaced housing cases 13. As shown on an enlarged scale in FIG. 2A, a bush 15 is supported internally of the housing cases 13 through bearings 14. Externally of the bush 15 are provided oil seals 16. A first hollow tubular spindle 111 is supported internally of the bush 15. The first spindle 111 is an outermost spindle.

A rotation transmitting member 18 such as a sprocket wheel is mounted on an intermediate portion of the first hollow spindle 111. The rotation transmitting member 18 is fixed axially by means of a collar 17. A key way 121 is also axially provided in the outer peripheral portion of the first spindle 111. A key 131 is inserted into the key way 121 and the rotation transmitting member 18 so that the rotation transmitting member 18 is slidable in an axial direction and rotatable integral with the spindle 111. As shown in FIG. 1, the rotation transmitting member 18 in the form of a sprocket wheel, is driven in rotation through transmission means such as chains 18*a* by a drive motor M. The output shaft Ma of the motor M extends in the bed 10 and has sprocket wheels 18*b* mounted thereon, around which the chains 18*a* are passed.

A key way 122 substantially equal in the range of the axial length to that of the above-described key way 121 is formed in the outer peripheral portion of a second hollow spindle 112, which is located internally of the first spindle 111. A key 132 is inserted into both the key ways 121 and 122 so that the first and second spindles 111 and 112 are relatively slidable in the axial direction and are rotatable integral with each other.

A key way 123 equal in the range of the axial length to that of the above-described key way 122 is formed in the outer peripheral portion of a third hollow spindle 113, which located internally of the second spindle 112. A key 133 is inserted into both the key ways 122 and 123 so that the second and third spindles 112 and 113 are relatively slidable in the axial direction and are rotatable integral with each other.

Further, a key way 124 equal in the range of the axial length to that of the above-described key way 123 is formed in the outer peripheral portion of a fourth core spindle 114, which is located internally of the third spindle 113. A key 134 is inserted into both the key ways 123 and 124 so that the third and fourth spindles 113 and 114 are slidable in the axial direction and is rotatable integral with each other.

A flange 19 is provided at the rear of one housing case 13 of the housing 12, and one ends of a plurality of supporting members 20 are fixedly connected to the flange 19. The supporting members 20 annularly cover the first spindle 111. A mounting plate 21 is fixedly mounted to the other ends of the supporting members 20. Pneumatic or hydraulic type fluid cylinders 141, 142, 143 and 144 are mounted on the mounting plate 21 and connected to the rear ends (the right ends in the figure) of the first to fourth spindles 111, 112, 113 and 114, respectively.

The first to fourth spindles 111, 112, 113 and 114 are arranged concentrically from outside to inside thereof and mutually slidably. The fluid cylinders 141, 142, 143 and 144 on the mounting plate 21 are positioned in the proximity of the spindles 111, 112, 113 and 114, respectively. Since the spindles located closer to the outside tend to have a larger diameter, it is preferred that a pair of or more than two fluid cylinders are arranged for each spindle on the same diameter of the spindle as shown in the end view of FIG. 3, taking the sliding balance into consideration. In the illustrated embodiment, the fourth spindle 114 is the smallest in diameter and is positioned on the center. Accordingly, the fourth fluid cylinder 144 is mounted at nearly the central position of the mounting plate 21. As illustrated in FIG. 2B, a bearing 174 is provided between the rear portion of the fourth spindle 114 and a coupling 164 connected to the end of a piston rod 154 of the fluid cylinder 144.

A pair of the third fluid cylinders 143 are installed on the mounting plate 21 at radially outer opposite positions of the central fourth fluid cylinder 144, and, as shown in FIG. 2B, a bearing 173 is provided between the rear of the third spindle 113 and an annular coupling 163 connected to the end of a piston rod 153 of each third fluid cylinder 143.

A pair of the second fluid cylinders 142 are installed on the mounting plate 21 at diametrically opposite positions displaced in phase by 90° relative to the above-described third fluid cylinders 143, and a bearing 172 is provided between the rear of the second spindle 112 and an annular coupling 162 connected to the end of a piston rod 152 of each fluid cylinder 142.

Figure 3:
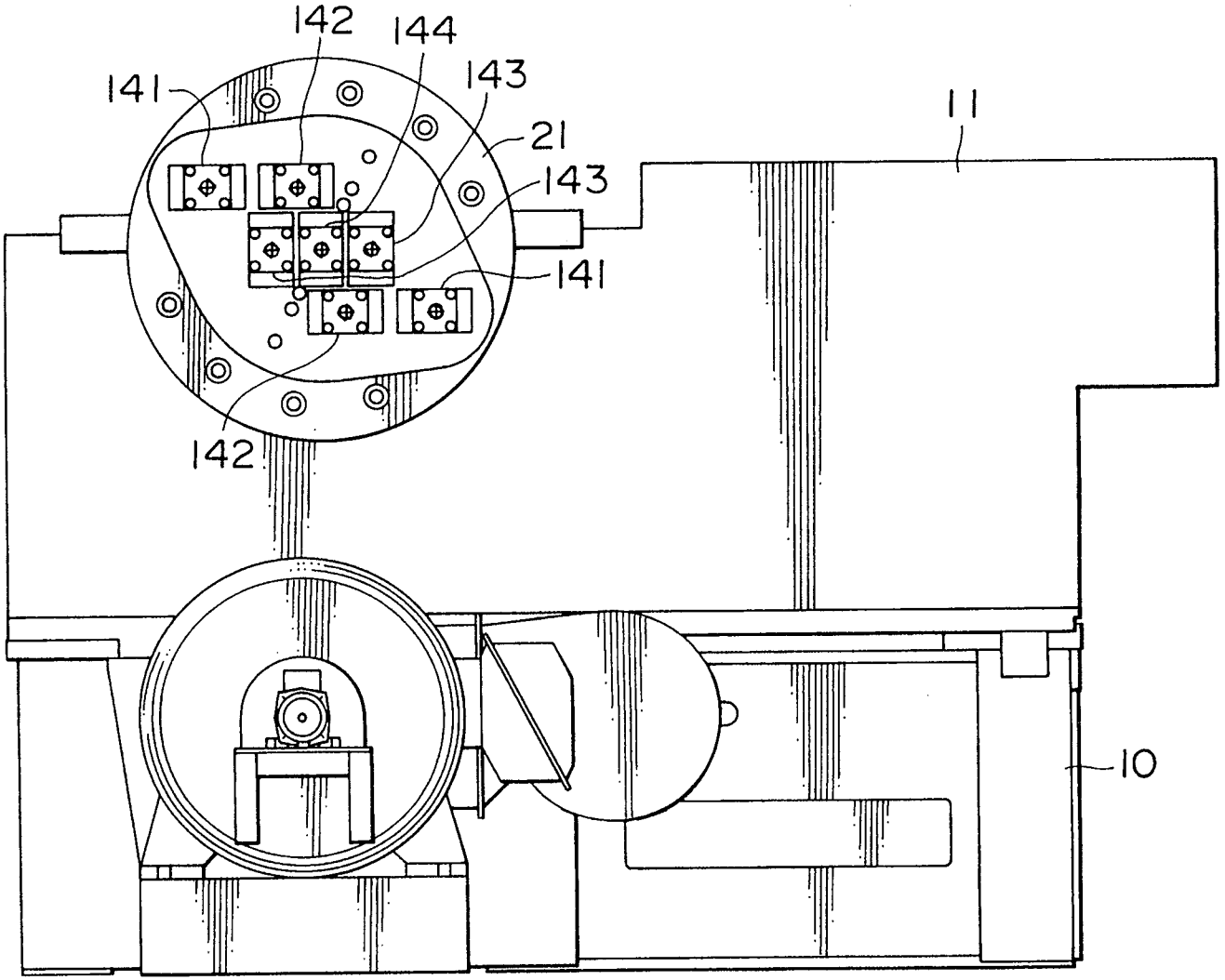
FIG. 3 is a side view as viewed from the right side of FIG. 1.

The second to fourth fluid cylinders 142, 143 and 144 are installed in the vicinity of the center of the mounting plate 21, so that, as shown in FIG. 3, a pair of the first fluid cylinders 141 are installed diametrically opposedly at positions furthermost from the center position of the mounting plate 21. The first spindle 111 is supported at the rear thereof via an annular bearing 171 by supporting members 161 which protrude internally at right angles to the axial direction from the end of a piston rod 151 of each first fluid cylinder 141.

Figure 2A:
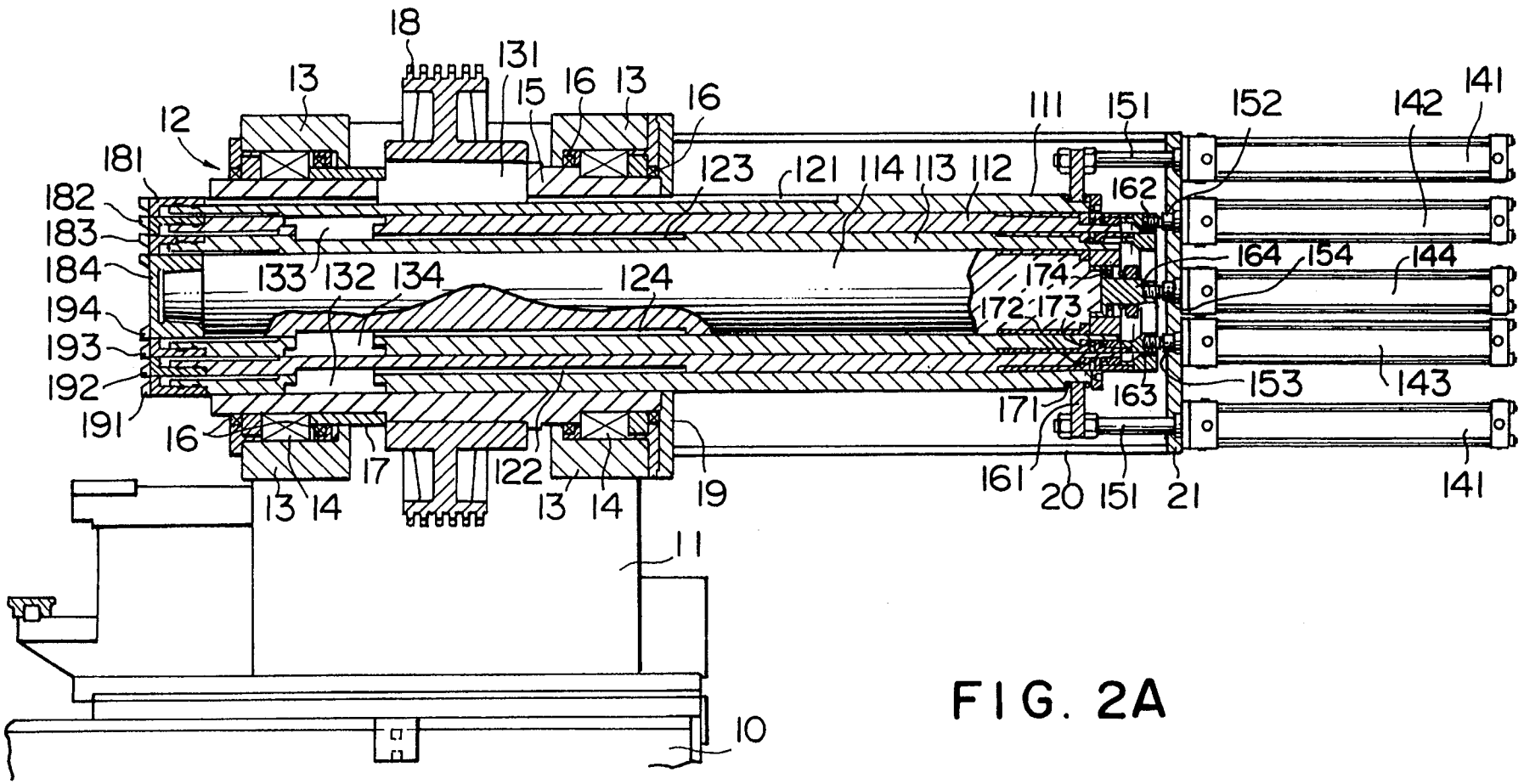
FIG. 2A is a front view, in longitudinal section, of a part of FIG. 1 on an enlarged scale.
Figure 2B:
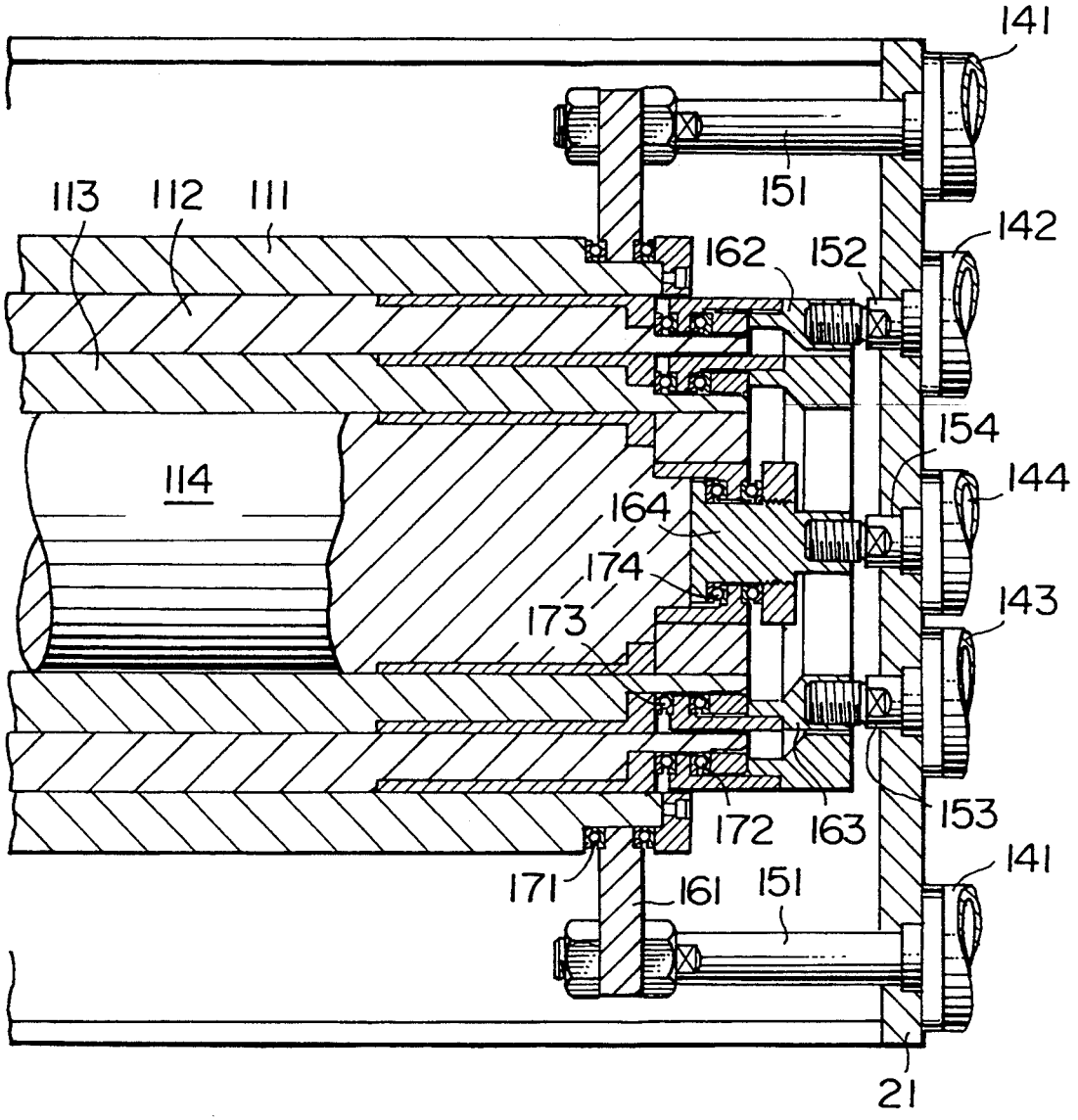
FIG. 2B is a sectional view, on a more enlarged scale, of a part of FIG. 2A.
Figure 4:
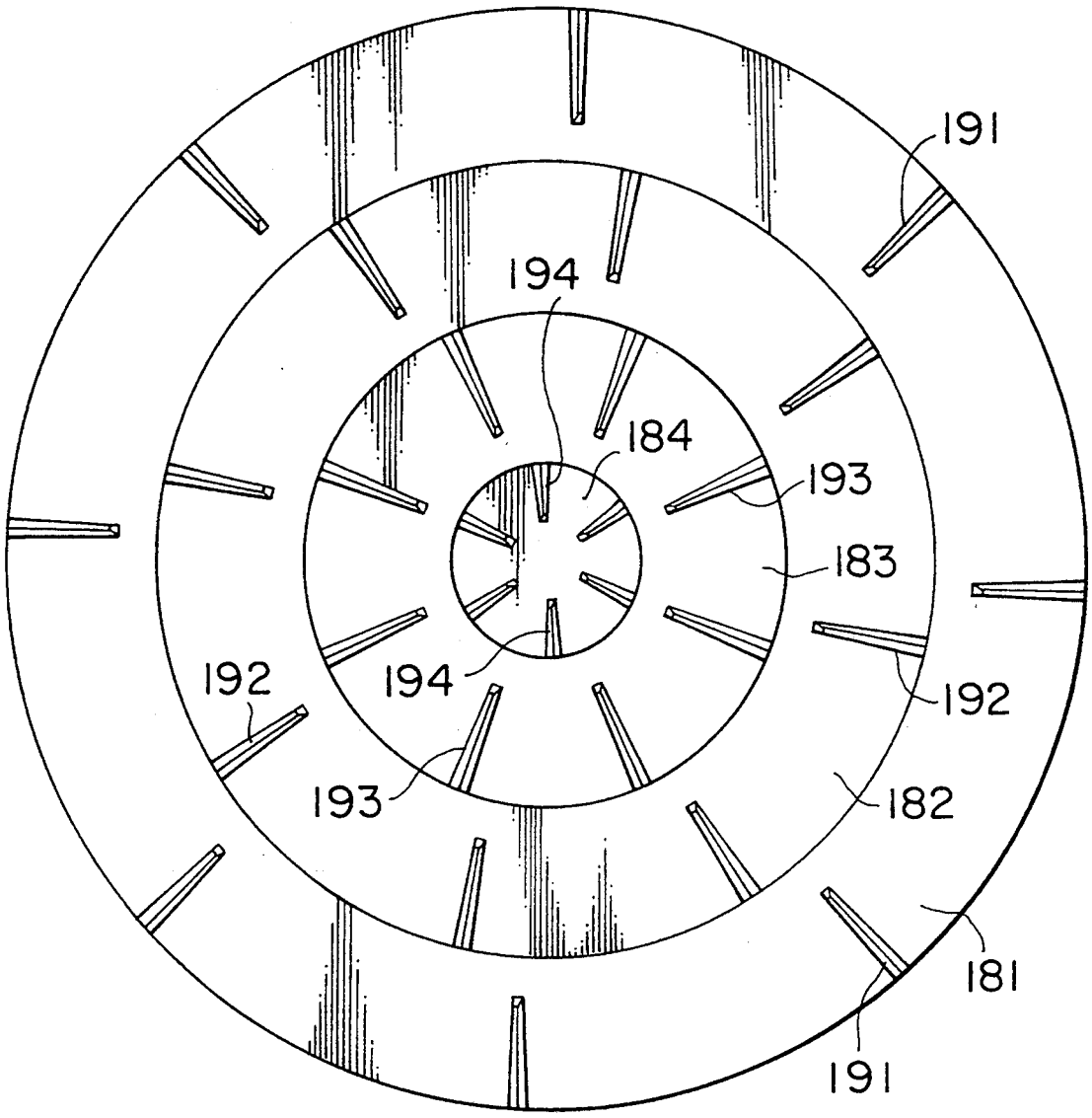
FIG. 4 is an enlarged end view of chuck bases as viewed axially thereof.

Mounted on the front ends of the spindles 111, 112, 113 and 114 are chuck bases 181, 182, 183 and 184 respectively, as shown in FIG. 2A. As indicated in FIG. 4, a plurality of pawls 191, 192, 193 and 194 are provided on the chuck bases 181, 182, 183 and 184, respectively. The pawls are suitably spaced apart peripherally and bite into the end faces 2 of the timber 1 to grip it. A total of the radial thicknesses of all the spindles corresponds substantially to the maximum radius of the timber 1.

Figure 5:
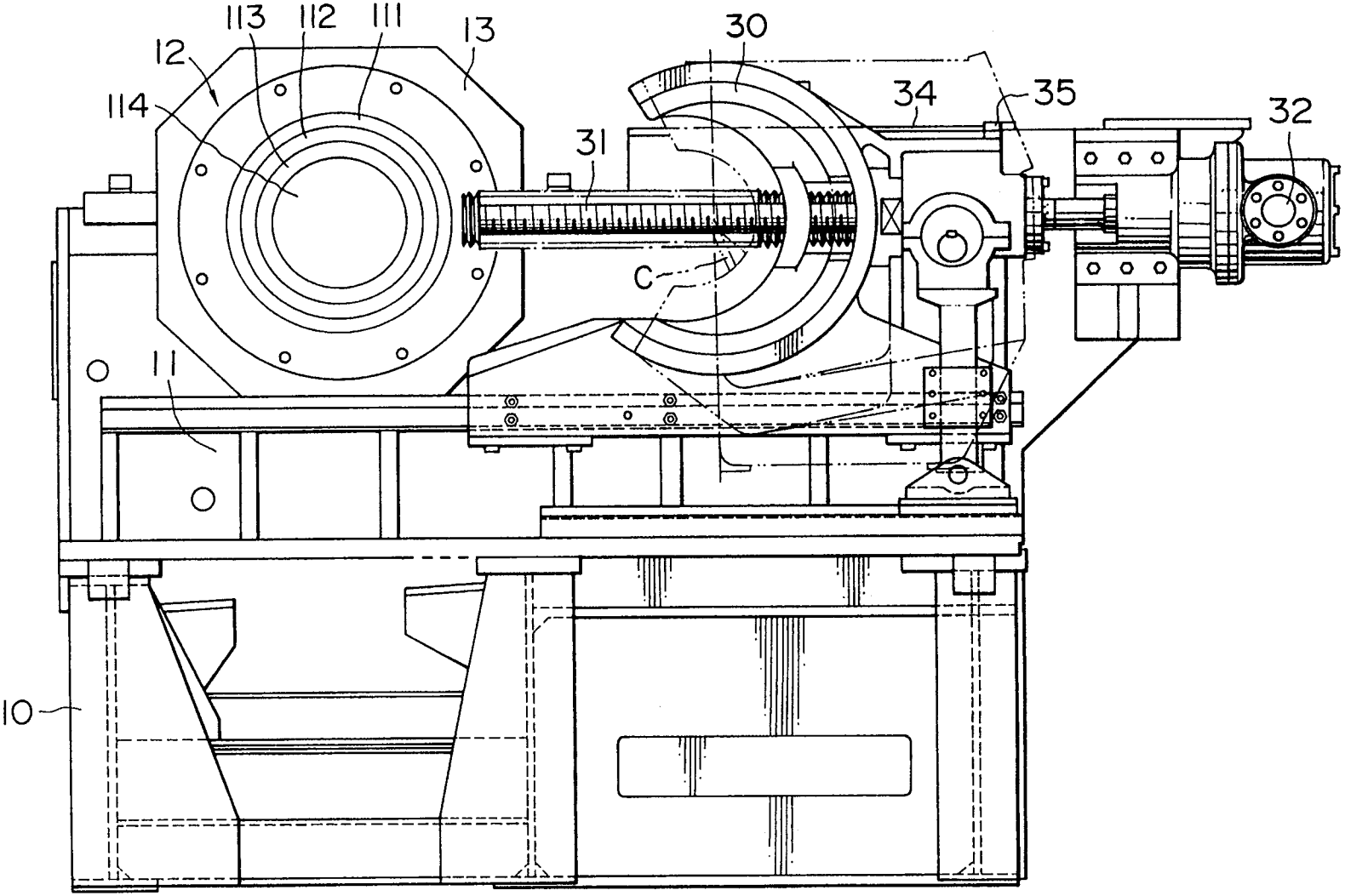
FIG. 5 is a side view of the timber cutting apparatus of FIG. 1, showing how the feeding displacement of a timber cutting knife is detected.
Figure 6:
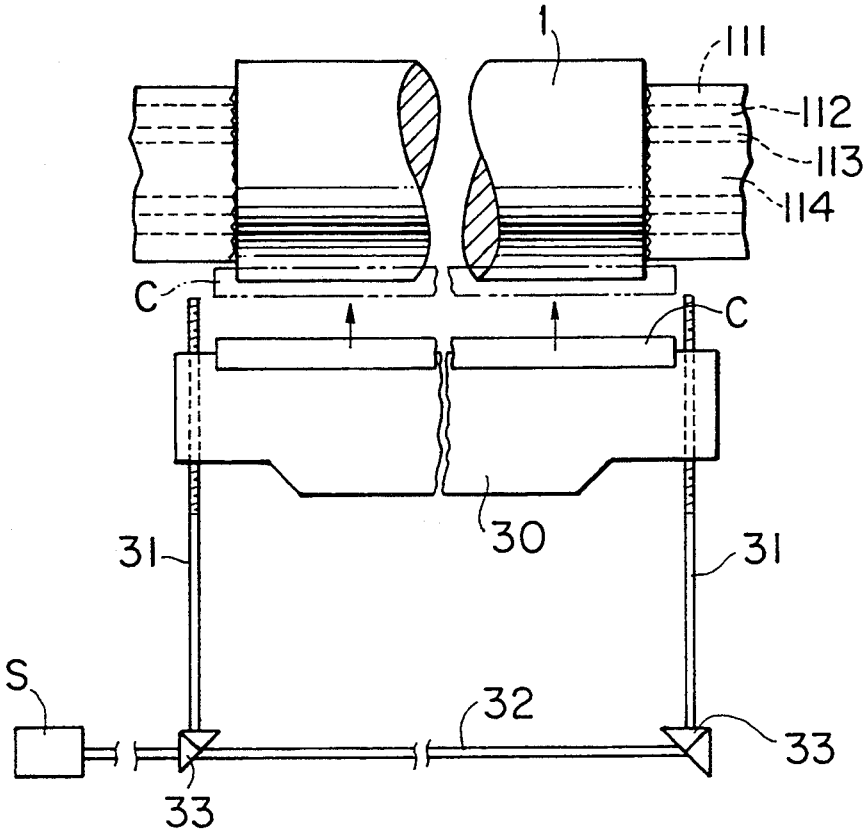
FIG. 6 is a schematic plan view showing how a knife head is advanced toward a timber.

As indicated in FIG. 5 which is a side view of FIG. 1, a knife head 30 is mounted on the bed 10 in a manner to be shiftable toward and away from the timber 1. Parallel feed screws 31 are passed through the knife head 30. As shown in FIG. 6, which is a schematic plan view, the feed screw 31 are driven by an incrementary drive shaft 32 through bevel gear transmissions 33. The shaft 32 is driven by a step motor S. The knife head 30 has a cutting blade or knife C extending along the axis of the timber 1.

Operation of the first embodiment of the present invention constructed as described above will now be described.

When loading a timber 1 into the veneer lathe, the first to fourth spindles 111 to 114 are caused to assume a state where these spindles 111 to 114 are retracted to a rearmost position by the operation of the respective fluid cylinders 141, 142, 143 and 144.

Normally, immediately before the timber 1 is loaded into the veneer lathe, its rotational center and diameter are measured by a timber centering device or an operator. The spindles 111 to 114 or the chuck bases 181 to 184 are in the state of concentric layers. Based on the information of the aforementioned rotational center and the diameter of the timber particularly the diameter of the timber, which spindles or chuck bases out of these layers are to be used is determined automatically or artificially. In the following description, the concentric layers are taken as four layers for the sake of explanation and the diameter of the timber is made slightly larger than that of the chuck base 181 on the outermost side for purposes of explanation. Furthermore, an example which uses all of the four chuck bases will be described below.

Fluid is first supplied to rear ports of the fluid cylinders 141 to 144, which are in most contracted state, to advance the chuck bases 181 to 184 on the front ends of the spindles 111 to 114 together with the pawls thereof, toward the end faces 2 at the opposite ends of the timber 1 loaded in the veneer lathe. All the spindles may be advanced simultaneously, or the spindles may be advanced with differences in time. For example, the innermost fourth spindle 184 may be first advanced, and after this, the third, second and first spindles 183, 182 and 181 at successively outer side of the fourth spindle 184 may be advanced in the order mentioned. In this case, the spindles in the state of concentric layers from the inner side to the outer side are slidingly advanced while being guided by the keys between the key ways.

Figure 25:
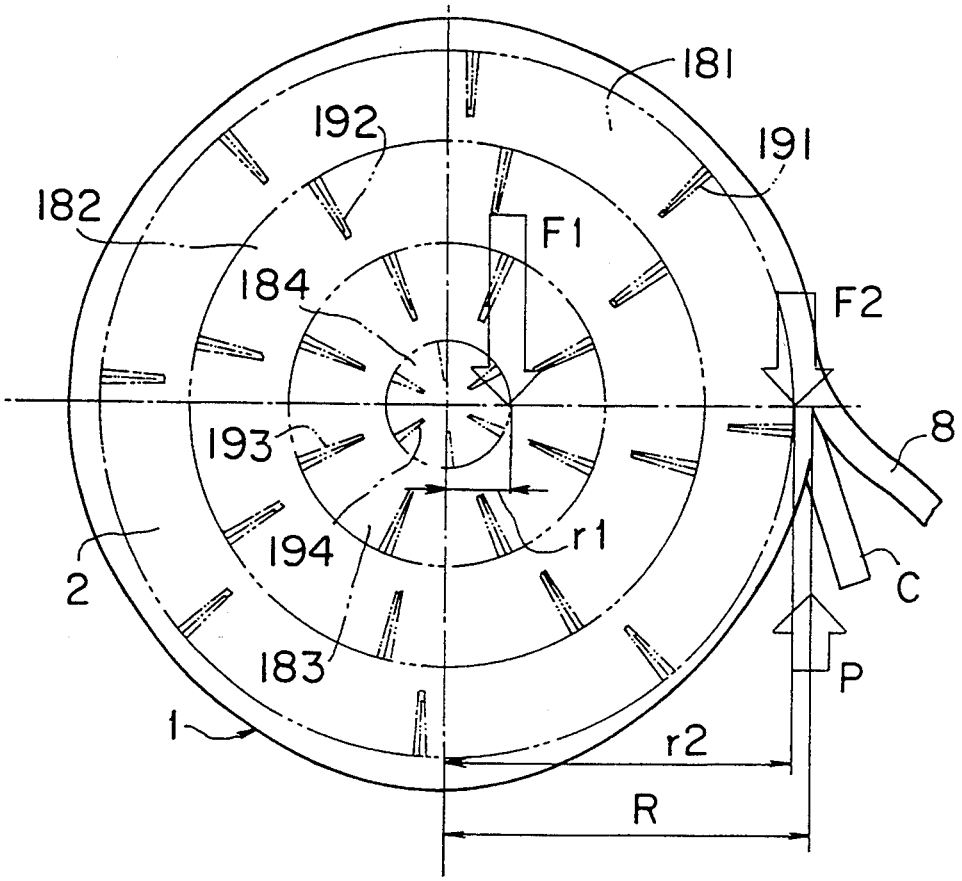
FIG. 25 is a schematic view as viewed axially illustrating a relationship between a gripping force of a pawl and a cutting resistance according to the present invention.

When all the pawls 191 to 194 of the chuck bases 181 to 184 bite into the end faces 2 at the opposite ends of the timber 1 at positions shown in FIG. 25, all the spindles are rotated by the motor M through the rotation transmitting means 18, 18*a* and 18*b*. On the other hand, with the rotation of the spindles, the knife C on the knife head 30 advances until it contacts the timber 1 and further advances by a distance corresponding to the thickness of a veneer 8 to be obtained from the timber 1, namely, by a distance corresponding to an incremental feed amount which is the amount to be rotary-cut for every 180° rotation of the timber to cut the veneer 8, as shown in FIG. 25. The knife C advances as the timber 1 is cut. The advance position of the knife C is controlled by detecting the distance between the spindle center and the knife C, namely, the changing diameter of the timber being cut. For example, the amount of the advancing displacement of the knife head subjected to incremental feed by the incremental drive shaft 32 may be detected by a linear displacement detecting device, a magnetic displacement detecting device, or an encoder. In any case, the detected amount is converted into an electric signal, and the supply and discharge of fluid into the respective fluid cylinders are controlled by a control system so that the spindles or chucks constituting concentric layers are retracted successively.

That is, the above-described control system compares the detected advance position of the knife head as a result of the incremental feed, with the gripping position of outermost chucking pawls out of all the pawls gripping the end faces 2 of the timber 1, and when both the positions become closest to each other, the spindle supporting the outermost pawls are retracted stepwise. At the time of start of cutting of the timber, the pawls 191 of the first spindle 111 come close to a part at which the outer periphery of the timber 1 is first cut by the knife C.

Figure 7:
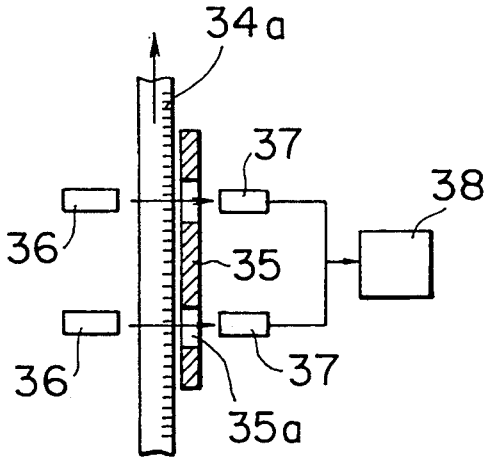
FIG. 7 is a schematic plan view showing the principle of a device for detecting the feeding displacement of the knife head or knife.

The control system will be described in more detail below. Referring to FIG. 5, a linear scale 34 is fixed on the knife head 30 in parallel with the feed screw 31. As shown in FIG. 7, the linear scale 34 has graduations 34*a* capable of being read optically. As the knife head 30 advances incrementarily to the timber, the linear scale 34 on the head 30 also advances as indicated by the arrow. Along the linear scale 34 there is provided a stationary indexing scale 35 having apertures 35*a*. Light emitting elements 36 emit light through the graduations 34*a* and the apertures 35*a* to light receiving elements 37, respectively. The light emitting elements 36 are typically LEDs, and the light receiving elements 37 are typically phototransistors or photodiodes. When the scale 34 is moved, the light arriving at each light receiving element 37 periodically changes in brightness due to the graduations 34*a*, and the change is converted into an electric signal and supplied to a displacement counter 38. The signals from the two light receiving elements 37 are sent to the counter 38 with a phase difference of 90°, for example. Thus, the amount of advancing movement of the knife head 30 and therefore the knife C can be detected.

Figure 8:
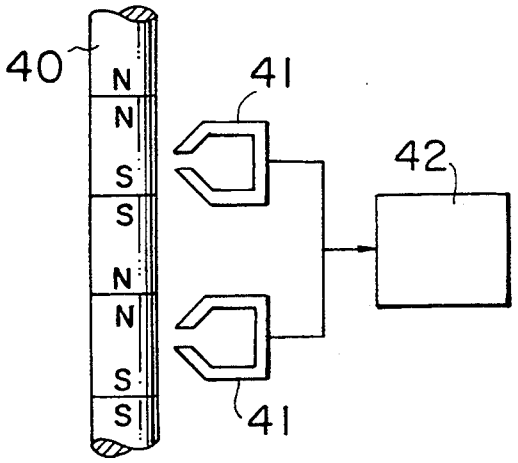
FIG. 8 is a schematic plan view showing the principle of another device for detecting feeding displacement of the knife head or knife.

Another displacement detecting device is shown in FIG. 8. A magnetic scale 40 having magnetic graduations may be mounted on the knife head 30, while magnetic heads 41 for detecting the graduations may be mounted on a stationary part of the lathe. The magnetic heads 41 supply electric signals to a displacement counter 42.

Figure 10:
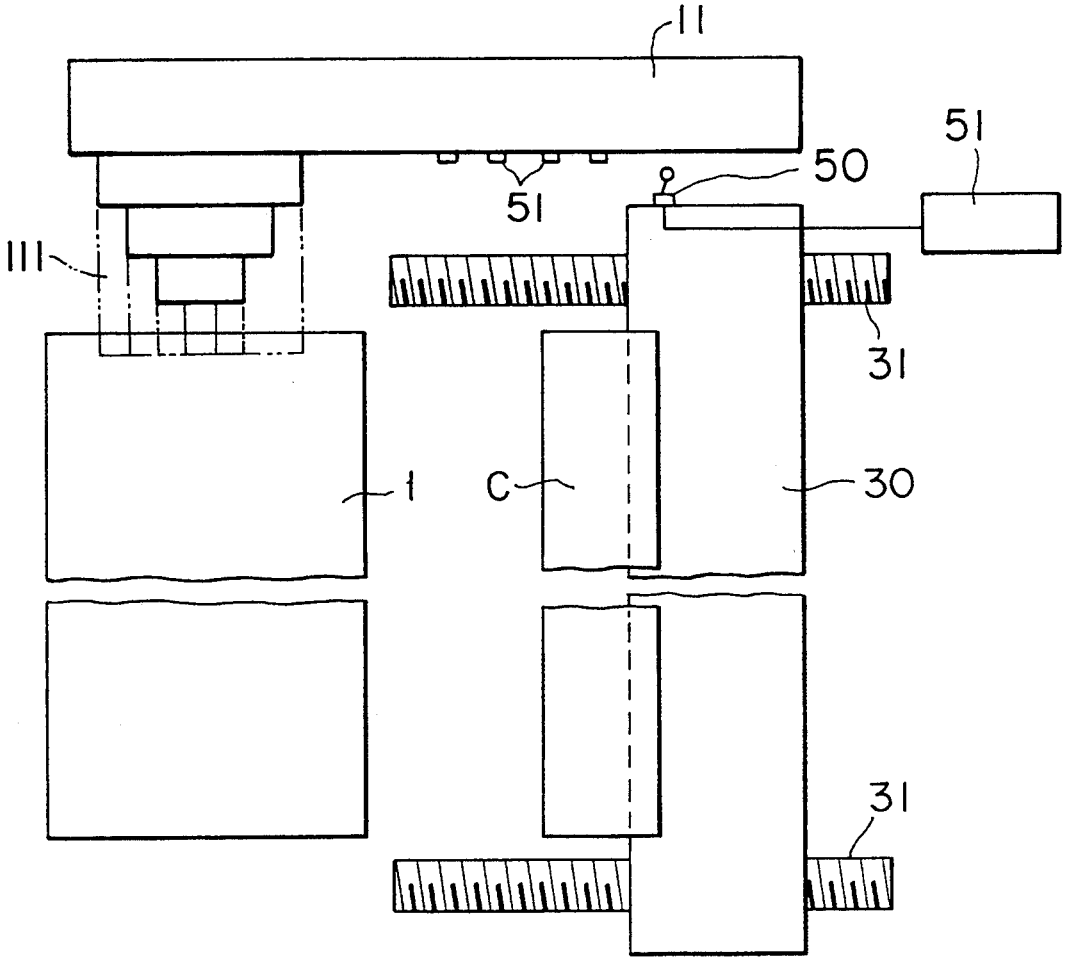
FIG. 10 is a schematic plan view showing another device for detecting the feeding displacement of the knife head or knife.

FIG. 10 shows a further displacement detecting device using a detecting switch 50 on the knife head 30. The lathe has the frame 11 extending along the path of the switch 50 and a series of dogs 51 are provided on the frame 11. As the knife head 30 and the knife C are advanced to the timber 1, the detecting switch 50 is successively acted upon by the dogs 51 and issues a series of signals which are counted and used in a counter 51 for detecting the displacement of the knife head 30.

Figure 9:
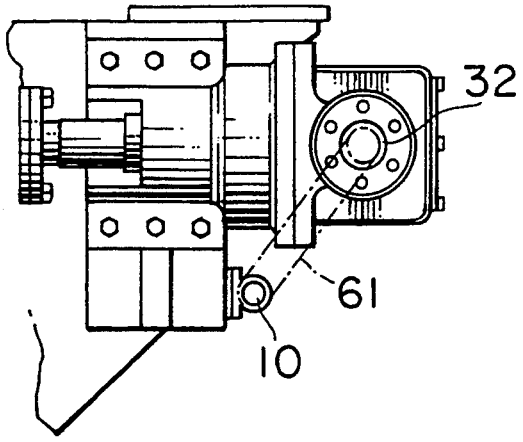
FIG. 9 is a fragmentary view showing a modified example of detecting the feeding displacement of the knife head or knife.

A still further displacement detecting device shown in FIG. 9 uses an encoder 60 which takes the rotary movement of the incrementary drive shaft 32 via transmission means 61. It will be understood that the amount of rotation of the incrementary drive shaft 32 represents the amount of displacement of the knife head 30 or knife C.

Figure 11:
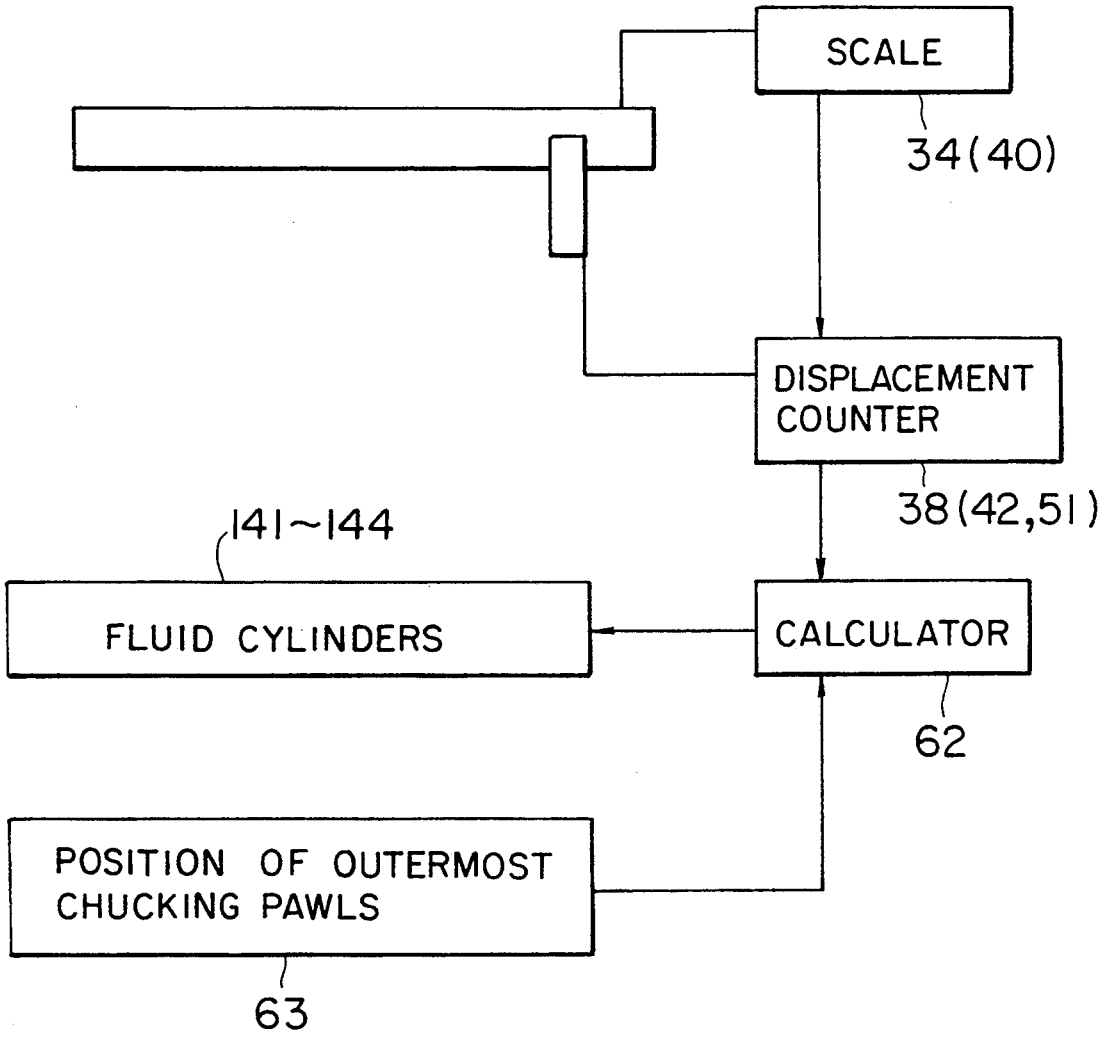
FIG. 11 is a block diagram of a control system, showing the manner of retracting a chuck base responsive to a feeding displacement of the knife head or knife.

FIG. 11 shows a block diagram of the control system of the lathe. The information of the displacement of the knife head 30 or knife C is supplied from the scale 34 or 40 to the displacement counter 38, 42 or 51 from which a signal is sent to a calculator 62, while information of the position (or diameter) of the presently outermost chucking pawls is inputted to the calculator 62 from a unit 63. When the calculator 62 determines as the cutting operation proceeds that the knife C has advanced to a position close to the outermost chucking pawls, then the calculator 62 outputs a signal to control valves (not shown) for supplying fluid into the fluid cylinders for the presently outermost spindles, so as to contract the fluid cylinders to thereby retract the outermost chucking pawls away from the end faces of the timber. It is to be understood that as the knife C advances further the next outermost chucking pawls are retracted in turn, and this control operation continues until the cutting is made to a diameter slightly larger than the diameter of the innermost chucking pawls.

Instead of supplying the information of the position from the unit 63, the positional information of the outermost chucking pawls may advantageously be detected and supplied by the scale 34 or 40.

Figure 12:
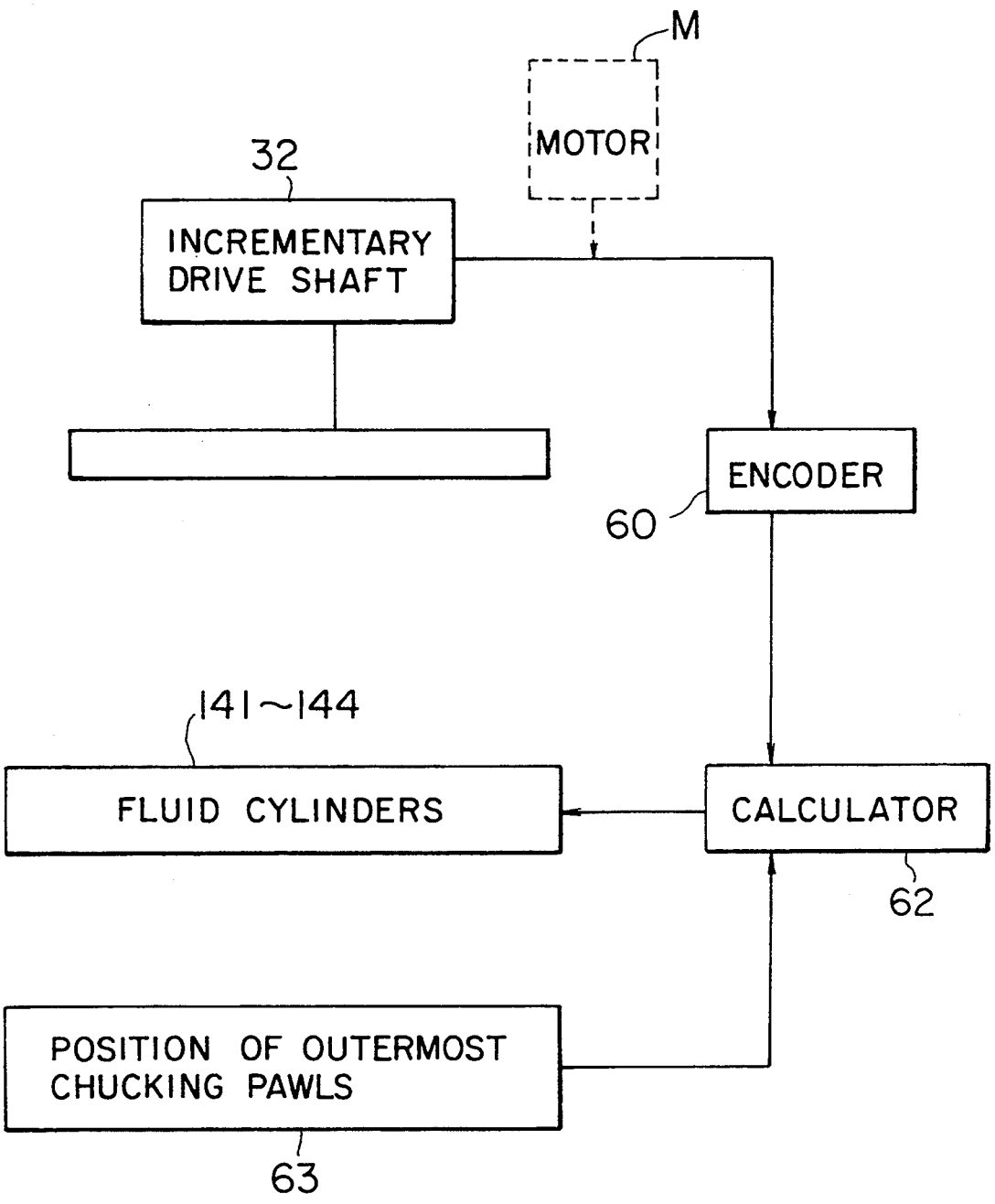
FIG. 12 is a block diagram showing a modification of the control system of FIG. 11.

FIG. 12 shows a control system using the encoder 60. The operation of the control system is substantially the same as that described with reference to FIG. 11. It will be understood that the encoder 60 may be operated directly by the motor M.

As indicated in FIG. 25, in the state where the outermost chucking pawls 191 bite into the end faces of the timber 1, the gripping force $F_2$ in the peripheral direction of the timber 1 is small because the radius r2 of the pawls 191 is large as will be understood from the figure, and the gripping force $F_2$ is only slightly larger than the cutting resistance force P. On the other hand, in the case where the timber is gripped by the innermost pawls 194, the gripping force $F_1$ is considerably large because the radius r1 of the pawls 194 is small.

When the cutting progresses further, the position of the pawls 192 of the second spindle 112 at the end faces 2 come closest to the peripheral part of the timber 1 being cut.

The time at which the pawls are to be retracted from the end faces 2 of the timber may be detected by detection elements such as reed switches, proximity switches, limit switches, etc. mounted at intervals along the path of displacement of the knife head or other member, or by a detection element mounted on the front end of the knife head, or by an operator.

In the foregoing description, the outermost chucking pawls are retracted at the same time at the two opposite end faces of the timber. However, the outermost chucking pawls may be caused to retract with different timings; that is, the chucking pawls at one end face of the timber is retracted first and then the chucking pawls at the opposite end face is retracted after the chucking pawls at the one end have retracted.

There is an unavoidable small clearance or play between radially adjoining spindles 111, 112, 113 and 114 and between radially adjoining chuck bases 181, 182, 183 and 184. There is also an unavoidable clearance or play in the knife head feed system because of a backlash existing in the system. These plays are absorbed in a balanced state wherein the knife on the knife head is pressed against the timber to exert to the timber transverse forces which take up plays between radially adjoining spindles and chuck bases.

Under such balanced state, if the outermost chucking pawls at the two opposite ends of the timber are retracted away from the timber at the same time, the balanced state will be broken instantaneously; that is, the timber will be pushed by the knife head transversely by a distance corresponding to a play between the outermost spindle (chuck base) and the immediately inner spindle (chuck base) so that the veneer 8 being cut will become thinner than a set value and may be damaged. Such a problem occurs every time the retraction of the chucking pawls is carried out.

On the other hand, when the corresponding chucking pawls are retracted at different times, the balanced state is broken at only one end region of the timber and the balanced state is still maintained at the other end region, so that the reduction of the thickness of, and damage to the veneer 8 being cut is suppressed to a minimum.

In order to carry out the above described retraction of the chucking pawls with different timings, a controller for producing actuating signals with a time difference is interposed between a calculator 62 (FIGS. 11 and 12) and the fluid cylinders 141–144. It is to be noted that the retraction of the chucking pawls at different timings may be made also in the embodiments of the invention which will be described below.

A second embodiment of the present invention will be described below with reference to FIGS. 13 and 14.

Figure 13:
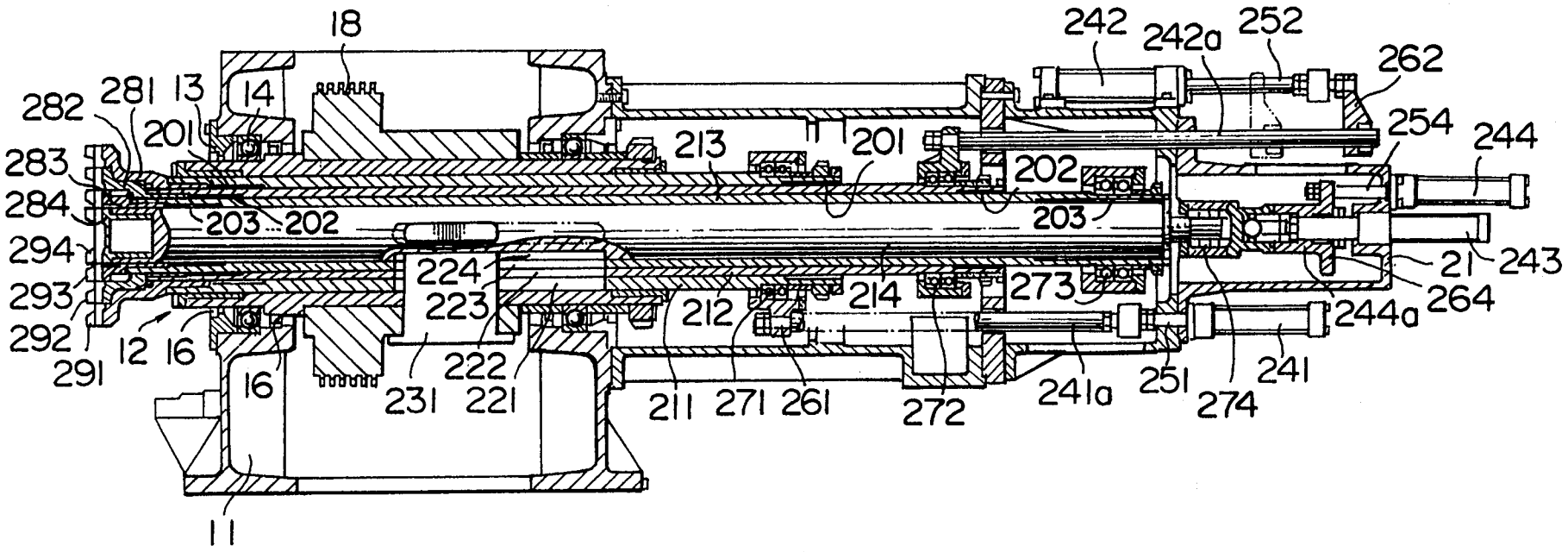
FIG. 13 is an enlarged longitudinal sectional view of essential portions of a timber cutting apparatus according to a second embodiment of the present invention.
Figure 14:
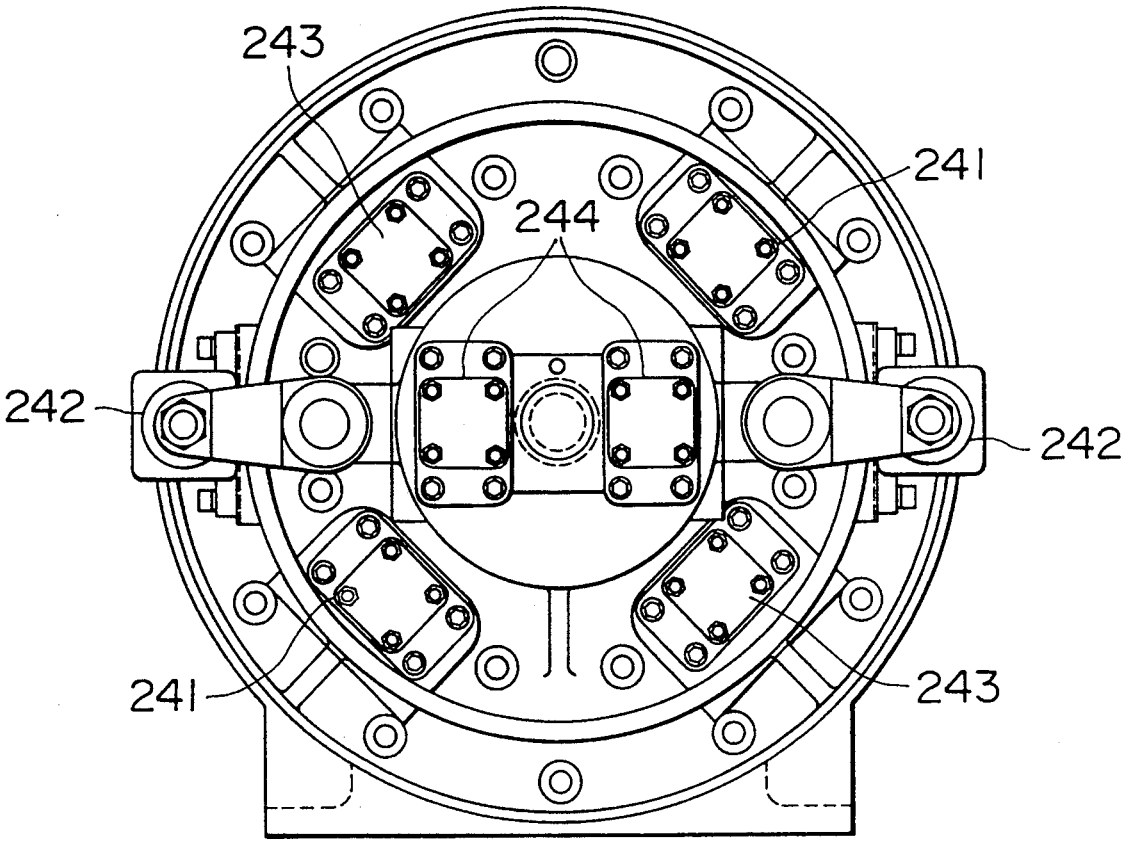
FIG. 14 is a side view as viewed from the right side of FIG. 5.
Figure 15:
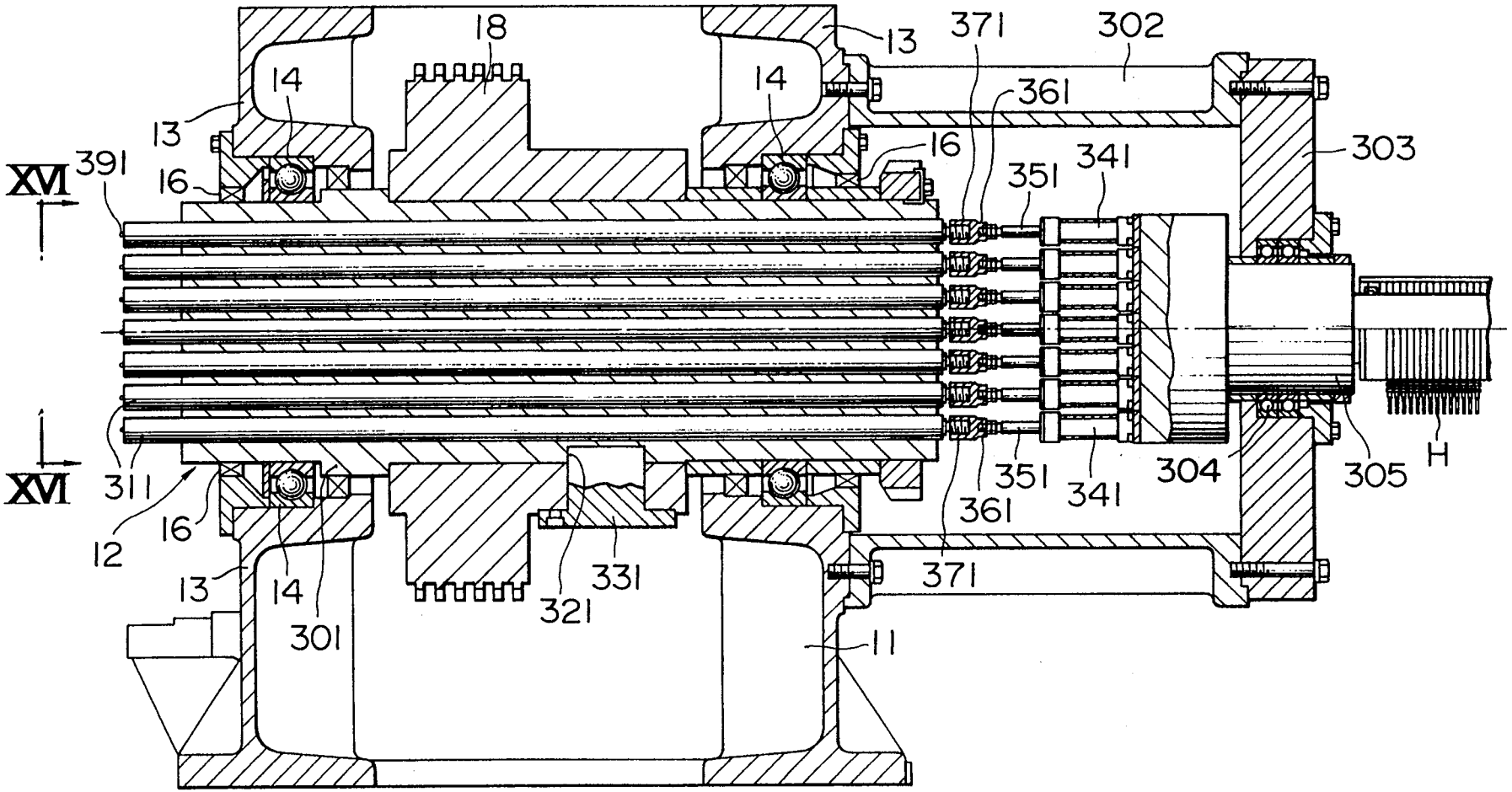
FIG. 15 is an enlarged longitudinal sectional view of essential portions of a timber cutting apparatus according to a third embodiment of the present invention.

In the second embodiment, as shown in FIG. 13, spindles 211, 212, 213 and 214 are so arranged that they are driven axially by fluid cylinders 241, 242, 243 and 244. These spindles are concentrically disposed from the inner side to the outer side and are shiftable independently. The second embodiment is fundamentally same as the above-described first embodiment. In the first embodiment, the axial lengths and the sliding distances of the spindles 111, 112, 113 and 114 are made the same as one another, and the fluid cylinders 141, 142, 143 and 144 are collectively installed on the mounting plate 21 at the rear thereof, whereas in the second embodiment, the lengths of the spindles 211, 212, 213 and 214 are made different from one another, and the mounting positions of the fluid cylinders 241, 242, 243 and 244 for axially moving the spindles 211, 212, 213 and 214 are made different in their axial direction.

More specifically, according to the second embodiment, the fourth fluid cylinder 244 for axially sliding the innermost fourth spindle 214 is protruded at the rearmost position, and a bearing 274 therefor is positioned at the rear of the fourth spindle 214. On the other hand, the third to the first spindles 213, 212 and 211 are provided with bearings 273, 272 and 271, respectively, at the rear ends thereof, and an inner spindle extends more rearwardly than a spindle located directly outside the inner spindle. The fluid cylinders 241, 242, 243 and 244 for sliding the spindles 211, 212, 213 and 214 are connected to the bearings 271, 272, 273 and 274 through rods 241*a*, 242*a*, 243*a* (not shown) and 244*a*, respectively. As shown in FIG. 14, the fluid cylinders 241, 242, 243 and 244 are provided in a diametrically opposed, paired relation.

Between the inner peripheral surface of the first spindle 211 and the outer peripheral surface of the second hollow spindle 212 positioned internally of the first piston 211, between the inner peripheral surface of the second spindle 212 and the outer peripheral surface of the third hollow spindle 213 positioned internally of the second spindle 212 and between the inner peripheral surface of the third spindle 213 and the outer peripheral surface of the fourth spindle 214 positioned internally of the third spindle 213 are formed key ways 221, 222, 223 and 224 each having the same length in the axial direction to constitute sliding parts. A common key 231 is inserted into the key ways 221, 222, 223 and 224 so that the spindles 211, 212, 213 and 214 are relatively slidably movable in the axial direction and can be rotated integral with each other in the peripheral direction. In the first embodiment described above, separate keys are used. However, in the second embodiment, the common key 231 is used since the wall-thickness of the spindles is made thin.

Chuck bases 281, 282, 283 and 284 are mounted on the front ends of the spindles 211, 212, 213 and 214, respectively, similarly to the above-described first embodiment. The chuck bases 181, 182, 183 and 184 in the above-described first embodiment have about the same diameter as that of the associated spindles while in the second embodiment, the wall-thickness of the spindles are made thin, so that the diameter of each chuck base 281, 282, 283 or 284 is made larger than the diameter of the associated spindle. When a timber 1 is gripped, the inner peripheral surface of any outer chuck base comes into contact with the outer peripheral surface of any inner base positioned directly internally. When releasing the gripping operation, all the chuck bases 281, 282, 283 and 284 may be retracted in unison axially from the end faces of the timber, or the chuck bases may be retracted successively from the outside to the inside. In this manner, the inner spindle or spindles are prevented from being retracted into the outer spindle or spindles. This is particularly advantageous in the case where the rear mutually sliding areas between the spindles are formed of bushes 201, 202 and 203 over a predetermined length.

In the second embodiment, fluid is first supplied to rear ports of the fluid cylinders 241 to 244 in a most contracted state to advance the chuck bases 281 to 284 at the front ends of the spindles 211 to 214, respectively. At that time, similarly to the case of the first embodiment, all the spindles may be advanced simultaneously. Alternatively the spindles may be advanced with differences in time. For example, the innermost fourth spindle 211 may be first advanced, and after this, the third, second and first spindles 212, 213 and 214 may be advanced in this order. Also in this case, the spindles disposed in coaxial layers from the inner side to the outer side are advanced while being guided by the keys between the key ways.

When all the pawls 291 to 294 of the chuck bases 281 to 284 bite into the end faces 2 at the opposite ends of the timber 1, the spindles are rotated through the rotation transmitting member 18. On the other hand, with the rotation of the spindles, the knife head advances by the thickness of a veneer 8 (FIG. 25) to be obtained from the timber 1, namely, by the incremental feed amount corresponding to the amount to be cut for every 180° rotation of the timber. The knife head advances as the timber 1 is cut. The advance position of the knife head is controlled by detecting the distance between the spindle center and the knife, in the same manner as described before with respect to the first embodiment with reference to FIGS. 7 through 12.

In the second embodiment, at the time of start of the cutting of the timber, the pawls 291 of the first spindle 211 come close to a part at which the outer periphery of the timber 1 is cut, to grip the end faces. When the outer surface of the timber is reduced to a diameter close to the pawls 291 as the cutting progresses, the pawls on the outermost layer is first moved backward while being guided by the key and retracted from the timber faces 2.

When the cutting progresses further, the position of the pawls 292 of the second spindle 212 come closer to the outer peripheral part of the timber 1. Other features are same as those of the first embodiment.

Figure 16:
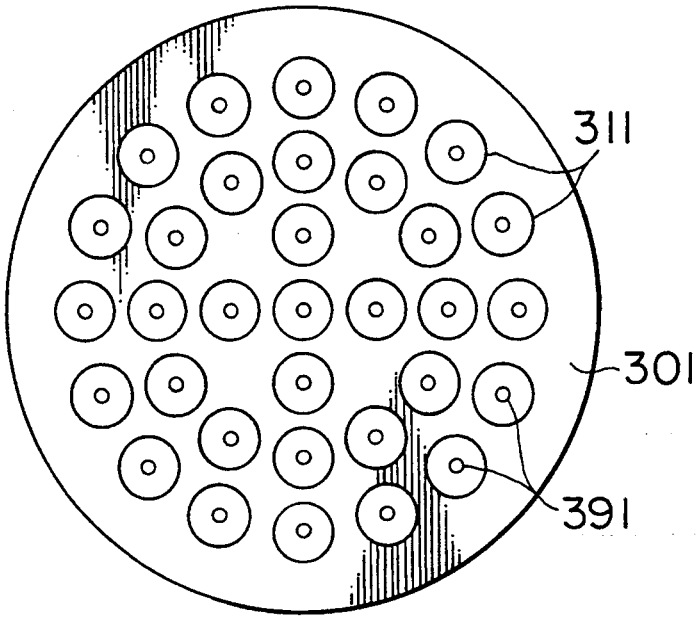
FIG. 16 is a view taken along the line XVI—XVI in FIG. 15.
Figure 17:
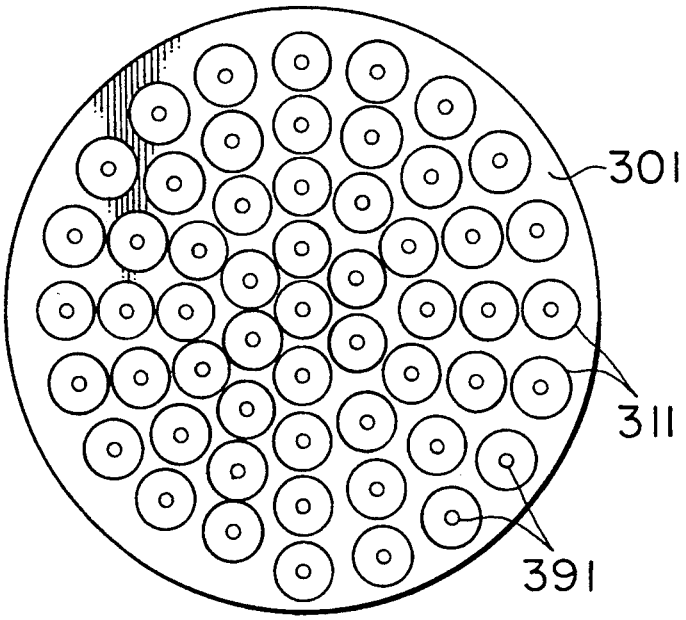
FIG. 17 is a view illustrating a modified embodiment of FIG. 16.

A third embodiment of the present invention will now be described with reference to FIGS. 15 to 21. As previously described, the pawls 191, 192, 193 and 194 in the first embodiment and the pawls 291, 292, 293 and 294 in the second embodiment are mounted through the chuck bases on the front ends of the spindles which are slidable relative to each other, and the pawls are mounted spaced apart in the peripheral direction of the chuck bases so that the radial dimension thereof is less than the radius of the spindles. On the other hand, in the third embodiment, a number of small-diameter spindles 311 are provided which have pawls 391 on the front ends thereof, and the spindles 311 are individually axially slidable. The spindles 311 are disposed in a bundle-like fashion parallel with the axial direction, as shown in FIGS. 16 and 17. All the spindles 311 are supported in holes of a columnar block 301 and these holes are of the same diameter as that of the spindles and are provided in the number corresponding to the spindles 311. the columnar block 301 is rotatably supported within a housing 12 by means of bearings 14, and a key 331 is inserted into a key way 321 of the columnar block 301 to integrally mount the rotation transmitting member 18.

Further, according to the third embodiment, a mounting plate 303 is secured to the end of a tubular supporting member 302 axially protruding from the rear of the housing 12. A short shaft 305 is rotatably fitted in a bearing 304 in the central portion of the mounting plate 303. A plurality of fluid cylinders 341 are mounted on the front of the short shaft 305. The spindles 311 each having a considerably smaller diameter than those of the first and second embodiments are mounted on the ends of piston rods 351 of the fluid cylinders 341, respectively. The short shaft 305 is coaxial with and rotatable together with the columnar block 301. The pawl 391 is fixedly mounted on the front portion of each spindle 311, the pawl 391 being adapted to bite into the end face 2 of the timber 1 to grip the latter. The fluid cylinders 341 mounted on the front of the short shaft 305 are separately operable, and if an arrangement thereof is made to be concentric as shown in FIG. 16, the pawls 391 mounted at the ends of the spindles 311 have an annular arrangement. Alternatively, it is also possible to arrange the spindles 311 along a spiral which is a cutting curve of the timber 1 as shown in FIG. 17.

At the rear of the short shaft 305 is installed a fluid supply and discharge mechanism H having a configuration as shown in FIGS. 18 to 21 in order to supply and discharge fluid into and from the fluid cylinders 341.

Figure 18:
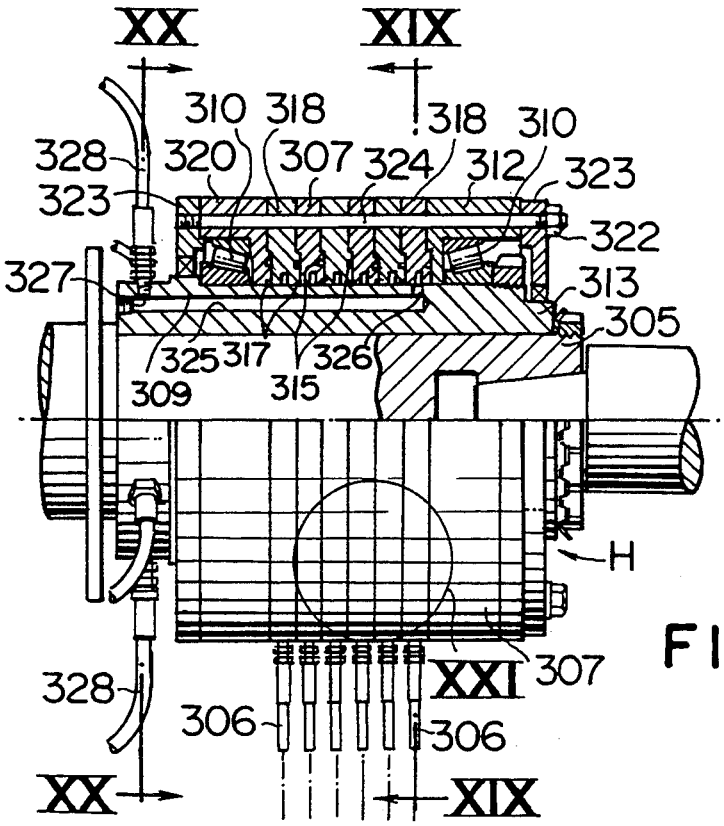
FIG. 18 is an enlarged sectional view illustrating a fluid supply-discharge mechanism of the apparatus shown in FIG. 15.
Figure 19:
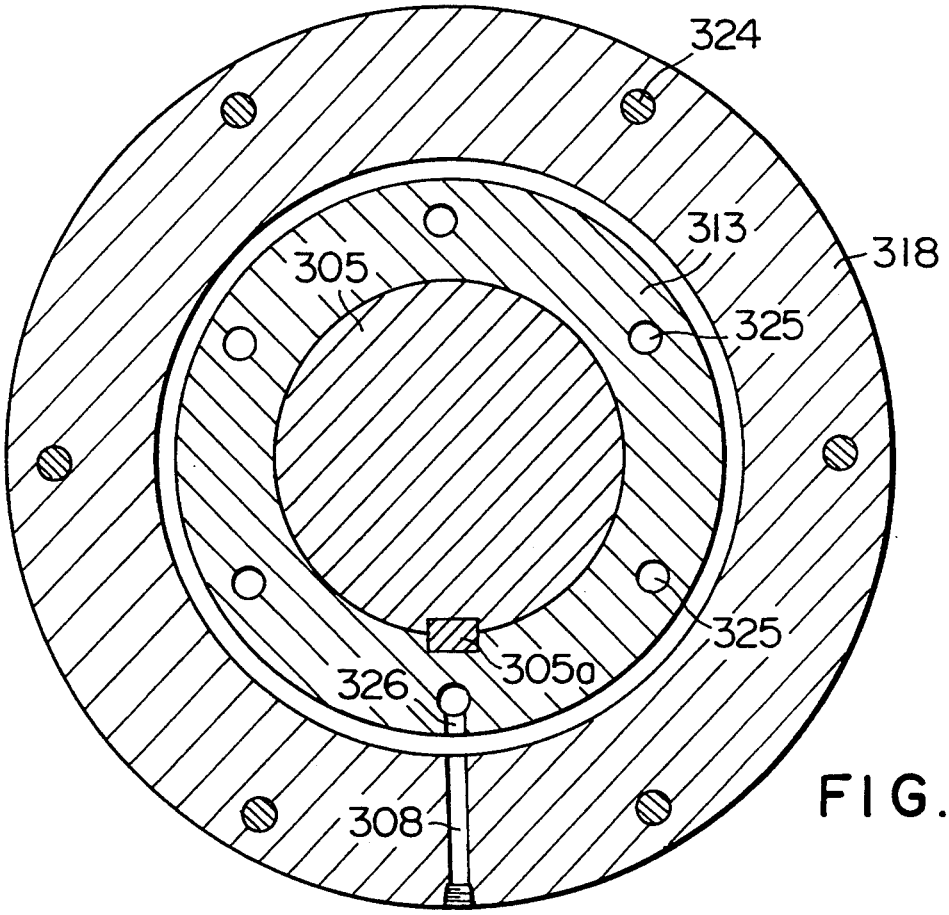
FIG. 19 is a view taken along the line XIX—XIX in FIG. 18.
Figure 20:
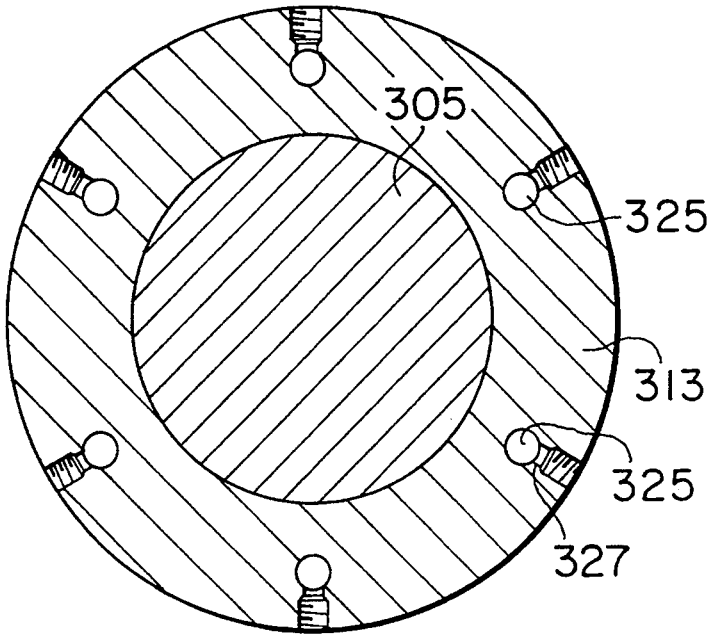
FIG. 20 is a view taken along the line XX—XX in FIG. 18.
Figure 21:
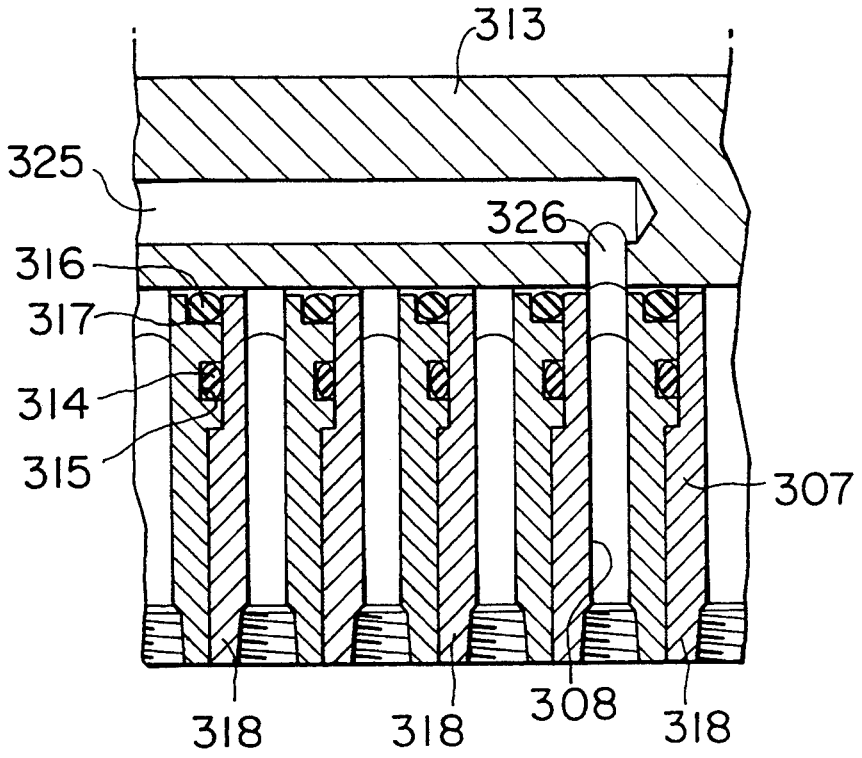
FIG. 21 is an enlarged view of the XXI portion in FIG. 18.

First, pipes 306 (FIG. 18) communicating with a fluid pressure source are connected with passages 308 (FIG. 21) radially bored in spaced apart positions with respect to the length of an external cylindrical body 307 fitted around a rear portion of the short shaft 305. A cylindrical body 313 is secured by a key 305*a* (FIG. 19) to the outer periphery of the short shaft 305. Fitted on the outer periphery of the short shaft 305 is a bearing case 312 encasing therein a bearing 310 as shown in FIG. 18. The external cylindrical body 307 comprises a plurality of disks 318. As shown in FIG. 21, these disks 318 each have a groove 315 for accommodating an O-ring 314 between adjacent disks and a groove 317 for accommodating an oil packing 316 in the sliding surface with respect to an internal cylindrical body 313. The disks 318 are axially placed one over another, each having the above-described passage 308. A bearing case 320 encasing therein a bearing 310 is fitted at the opposite end of the bearing case 312. A bolt 324 extends through the bearing case 320, the disks 318, the bearing case 312 and a lids 323, which are integrally tightened by a nut 322. The start ends of lengthwise passages 325 bored spaced apart in the peripheral direction of the cylindrical body 313 are bought into communication with the radial passages 308 through auxiliary passages 326, respectively. At the terminal of each lengthwise passage 325, a conduit 328 is connected at one end thereof to a hole 327 extending to the outer peripheral surface of the cylindrical body 313, and the other end of the conduit 328 is connected to a port of each fluid cylinder 341 (FIG. 15) so as to control the supply and discharge of fluid into and out of the fluid cylinder 341.

According to the third embodiment, fluid is first supplied to a rear port of the fluid cylinder 341, which is in a most contracted state, to advance the pawl 391 at the front end of the spindle 311. All the spindles 311 may be advanced. Alternatively, the spindles may be advanced with differences in time. For example, the innermost spindle may be first advanced, and after this, the outside spindles may be advanced.

Also in this third embodiment, the feed control of the knife head is similar to the case of the embodiments previously described. Further, the manner of operation of the afore-mentioned embodiments will also apply to this third embodiment wherein as the diameter of the timber reduces with the progress of the cutting, the pawls 391 are axially retracted in the order from the outermost ones to the innermost ones. Moreover, the control of the timing at which the retracting movement of the pawls is accomplished is the same as that as described in the foregoing embodiments. Furthermore, in the case where the spindles 311 are arranged in a spiral fashion as indicated in FIG. 17, the spindles 311 may be retracted away from the end faces of the timber sequentially in accordance with the spiral cutting of a veneer 8. This is particularly advantageous when the cutting thickness of the veneer 8 is large.

Figure 22:
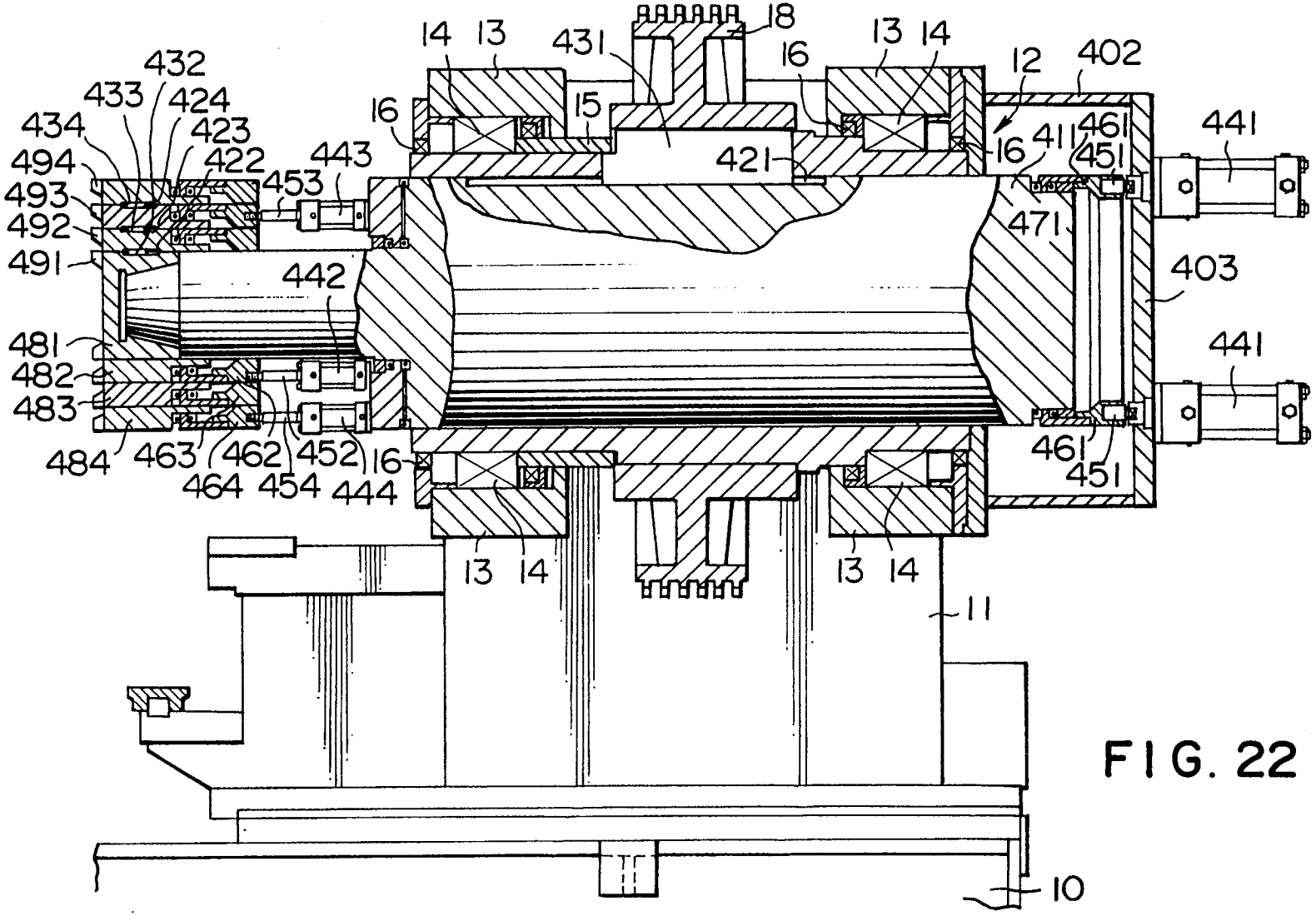
FIG. 22 is an enlarged longitudinal sectional view of essential portions of the timber cutting apparatus according to a fourth embodiment of the present invention.

Now, a fourth embodiment of the present invention will be described with reference to FIG. 22. In the above-described first to third embodiments, pawls are mounted on the ends of a plurality of mutually slidable spindles. On the other hand, according to the fourth embodiment, a plurality of chuck bases 481, 482, 483 and 484 are disposed on the front end of a spindle 411 which is supported to be retractable and rotatable with respect to the end face 2 of the timber 1. The chuck bases 481, 482, 483 and 484 are coaxial and axially slidable independently.

The single spindle 411 for each end face of the timber is supported through a bush 15 in a housing 12 on each frame 11, and a rotation transmitting member 18 such as a sprocket wheel is mounted on the outer periphery of the spindle 411 so as to be rotatable integral with the spindle 411 by means of a key 431. The key 431 is inserted into a key way 421 formed at a predetermined portion of the spindle 411. A mounting plate 403 is fixed to an annular supporting member 402 extending rearwardly of the housing 12. A coupling 461 is connected to an end of a piston rod 451 of each of first fluid cylinders 441 mounted on the plate 403 to axially slide the spindle 411 supported through a bearing 471 at the rear of the spindle 411.

The spindle 411 is formed at its front portion with a supporting shaft 401 having a reduced diameter, and a first chuck base 481 is mounted on the front end of the supporting shaft 401. A second chuck base 482 is fitted around the outer periphery of the first chuck base 481, and a key 432 is inserted in a key way 422 formed at least in a sliding region thereof. A third chuck base 483 is fitted around the outer periphery of the second chuck base 482, and a key 433 is inserted in a key way 423 formed at least in a sliding region thereof. Further, a fourth chuck base 484 is fitted around the outer periphery of the third chuck base 483, and a key 434 is inserted in a key way 424 formed at least in a sliding region thereof. All these chuck bases are integrally rotatable around their common axis.

Between the rear of the first to fourth chuck bases 481, 482, 483 and 484 and a front annular shoulder of the spindle 411 are arranged a pair of or more than two fluid cylinders which are opposedly disposed on the same diameter with respect to the same chuck base. In the illustrated embodiment, the first chuck base 481 is mounted on the front end of the supporting shaft 401. Accordingly, the first chuck base 481 is axially movable forward and backward by means of the first fluid cylinders 441. Piston rods 452 of second fluid cylinders 442 are connected via an annular coupling 462 to the second chuck base 482 at diametrically opposite positions. In like manner, piston rods 453 and 454 of third and fourth fluid cylinders 443 and 444 are connected via annular couplings 463 and 464 to the third and fourth chuck bases 483 and 484, respectively. Annularly mounted on the front surfaces of the chuck bases 481, 482, 483 and 484 are a plurality of spaced apart pawls 491, 492, 493 and 494 which bite into and grip the end faces of the timber 1.

In the fourth embodiment, fluid is supplied to the first to fourth fluid cylinders 441 to 444 to advance the chuck bases 481 to 484, in the manner similar to that of the embodiments previously described.

When all the pawls of the chuck bases 481 to 484 bite into the end faces 2 of the timber 1, the spindles are rotated through the rotation transmitting member 18 so that the knife starts to cut the timber 1. The control of the retracting movement of the chuck bases is carried out in the manner similar to that of the embodiments previously described.

That is, the advance position of the knife is detected and compared with the gripping position of the outermost pawls out of the pawls 491 to 494 which are gripping the end faces 2 of the timber. When these positions assume mutually closest positions, the pawls are retracted stepwise from the outermost to the innermost. Control of this retracting movement is also carried out in the manner similar to that of the embodiments previously described.

Finally, a fifth embodiment of the present invention will be described with reference to FIGS. 23 and 24.

According to the fifth embodiment, tubular sliding members 562, 563 and 564 are concentrically provided behind second to fourth chuck bases 582, 583 and 584. The rear ends of the sliding members 562 to 564 extend into hydraulic cylinders 542, 543 and 544, respectively. Pistons 552, 553 and 554 mounted on the rear ends of the sliding members 562, 563 and 564 are slidable within the hydraulic cylinders 542, 543 and 544, respectively. Pressurized oil can be supplied and discharged into and out of front and rear cylinder chambers on both sides of the pistons.

Figure 23:
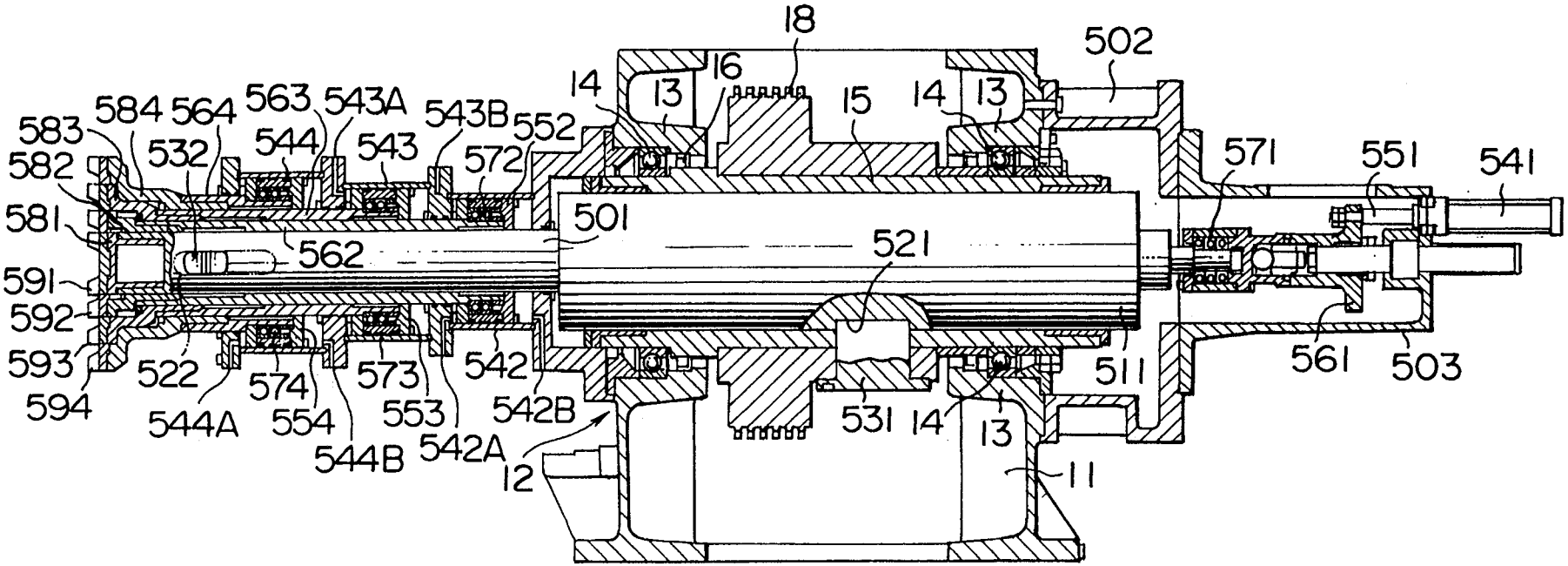
FIG. 23 is an enlarged longitudinal sectional view of essential portions of the timber cutting apparatus according to a fifth embodiment of the present invention.
Figure 24:
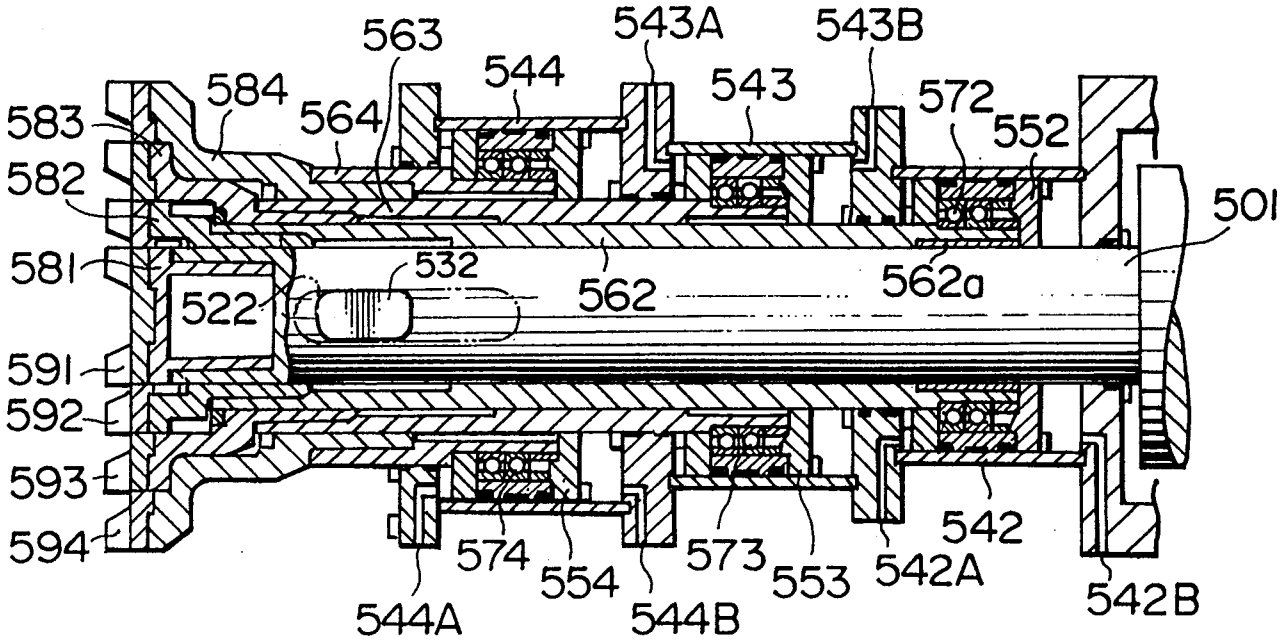
FIG. 24 is an enlarged sectional view of a part in FIG. 23.

As shown in FIG. 23, a single spindle 511 is slidably supported in the housing 12 of the slide 11 through a bush 15, and a rotation transmitting member 18 such as a sprocket wheel is supported on the outer periphery of the spindle 511 so that the rotation transmitting member 18 is rotatable integral with the spindle 511. To this end, a key 531 is inserted into a key way 521 formed in the spindle 511 and so on. A tubular mounting member 503 is coaxially fixed to a tubular supporting member 502 extending from the rear portion of the housing 12. A coupling 561 is connected to the end of each piston 551 for first fluid cylinders 541 mounted on the mounting member 503, and the rear portion of the spindle 511 is connected to the coupling 561 through a bearing 571.

The spindle 511 is formed at its front portion with a supporting shaft 501 having a reduced diameter, and a first chuck base 581 is mounted on the front end of the supporting shaft 501. The second chuck base 582, third chuck base 583 and fourth chuck base 584 are successively mounted around the supporting shaft 501. These chuck bases are integrally rotatable due their key connection but axially slidable independently.

The front end of the second tubular sliding member 562 is fitted on the supporting shaft 501 at the rear of the second chuck base 582. The sliding member 562 is supported on the supporting shaft 501 through a key way 522 and a key 532, and a bush 562*a* is fitted at the rear end thereof. The piston 552 is supported through a bearing. 572 on the rear portion of the sliding member 562. The supply and discharge of pressurized oil into and from front and rear ports 542A and 542B of the hydraulic cylinder 542 encasing therein the piston 552 cause the second chuck base 582 to slide forward and backward with respect to the supporting shaft 501. The third chuck base 583 is connected to the piston 553 and the hydraulic cylinder 543 encases therein the piston 553 at the rear portion of the third tubular sliding member 563 which is slidable on the second tubular sliding member 562. The fourth chuck element 584 is connected to the piston 554 and the hydraulic cylinder 544 encases therein the piston 554 at the rear portion of the fourth tubular sliding member 564 which is slidable on the third sliding member 563. Thus, the first to fourth chuck bases 581, 582, 583 and 584 are mutually slidable in their concentric state. Pawls 591, 592, 593 and 594 for gripping the end faces 2 of the timber are annularly mounted in spaced apart positions on the front surfaces of the chuck bases 581, 582, 583 and 584, respectively.

Operation of the fifth embodiment is substantially the same as that of the fourth embodiment. Fluid is supplied to the first fluid cylinder 541 and the other fluid cylinders 542 to 544 to advance the chuck bases 581 to 584.

When all the pawls 591 to 594 of the chuck bases 581 to 584 bite into the end faces 2 of the timber 1, the spindles are rotated by the rotation transmitting member 18, and the knife 1 starts to cut the timber 1. The control of the retracting movement of the chuck bases 581 to 584 in turn is substantially the same as the case of the embodiments previously described. The only substantial difference of this fifth embodiment is that the sliding members 562, 563 and 564 have the function of the hollow spindles in the previous embodiments.

While in the first, second, fourth and fifth embodiments, the spindles and the chuck bases have been comprised of four layers for the sake of convenience, it is to be noted that the number thereof may be increased or decreased and the spacing between the layers may be changed, in dependency of the diameter and other characters of the timber. Furthermore, while in the present embodiments, the mechanism for moving the spindles or chuck bases forward and backward has been described as fluid pressure mechanism for the sake of convenience, it is to be noted that the mechanism may be of the other type such as a screw drive type, a crank drive type, a rack and pinion drive type, a link motion type, etc.

As described above, according to the present invention, positions of the end faces of a timber adjacent to the outer periphery thereof are always gripped by the chuck pawls so that the gripping force required to cut a timber is made approximately equal to the cutting resistance force, whereby a stabilized cutting state can be maintained irrespective of kinds, characters and sizes of the timber.

Furthermore, according to the present invention, even in a case where the end face of a timber has a rotten part, a crack or cracks and/or a punky part in the center region thereof, the timber can be securely held by the pawls because the timber is gripped by the pawls over substantially the entire end faces including a radially outer region of the rotten, cracked and/or punky part so that a required torque can be transmitted to the timber via the pawls. Therefore, the present invention is useful in that it enables utilization of timbers having a rotten, cracked and/or punky part in the central region. Such timbers have not been utilized heretofore because of the difficulty in gripping the end faces.

What is claimed is:

1. A method of rotary-cutting a timber in a veneer lathe, comprising:

providing a pair of first and second opposite chucking pawl means which are in a spaced, confronting relationship with respect to an axis of rotation of the timber;

loading the timber into the veneer lathe between the first and second chucking pawl means;

moving the first and second chucking pawl means toward each other to cause the pawl mens to bite into opposite end faces of the timber so as to grip the timber between the opposite chucking pawl means and on the axis of rotation;

driving the opposite chucking pawl means in rotation so as to rotate the timber around the axis of rotation; and advancing a cutting knife extending along the axis of rotation against the timber being rotated to rotary-cut the timber so as to peel off a veneer from an outer peripheral portion of the timber;

said method further comprising the steps of:

providing each of the first and second chucking pawl means with a plurality of chucks with pawls, said chucks including a radially outermost chuck, at a maximum distance from said axis of rotation, a radially innermost chuck at a minimum distance from said axis of rotation, and at least one intermediate chuck between said outermost and said innermost chucks, said chucks all being axially displaceable independently from each other;

at the start of the rotary-cutting operation, gripping the timber by the opposite chucking pawl means with the outermost chuck of each pawl means gripping the timber at positions adjacent to the outer peripheral surface thereof;

as the cutting knife advances to a radial position of the timber close to the radially outer periphery of the outermost chuck, retracting the outermost chuck away from the related end face of the timber with the next radially inner chuck gripping the timber;

as the cutting knife further advances to a radial position of the timber close to the radially outer periphery of said next inner chuck, retracting said next inner chuck away from the related end face of the timber; and repeating the cutting operation in the same way as above until the cutting knife advances to a radial position of the timber close to the radially outer periphery of said innermost chuck.

2. The method according to claim 1, further comprising the step of causing all of the chucks of said first and second chucking pawl means to bite into the end faces of the timber when the timber is gripped at the start of the rotary-cutting operation.

3. The method according to claim 1, wherein said chucks are advanced against, and retracted away from the end faces of the timber in a concentric way.

4. The method according to claim 1, wherein said chucks are advanced against, and retracted away from the end faces of the timber along parallel paths.

5. The method according to claim 1, wherein said chucks are advanced and retracted by fluid pressure.

6. The method according to claim 1, further comprising the steps of:

detecting the advancing displacement of the cutting knife relative to the axis of rotation of the timber;

inputting the detected displacement of the knife to a calculator;

inputting positional information of a radially outer periphery of the outermost chuck to said calculator;

executing a calculation in said calculator responsive to the inputted displacement and the inputted positional information;

issuing an output signal from the calculator when the inputted displacement and the inputted positional information become close to each other, to retract the outermost chuck away from the related end face of the timber;

inputting positional information of the radially outer periphery of said next inner chuck to said calculator;

executing a calculation in said calculator responsive to the inputted displacement and the inputted positional information of said next inner chuck;

issuing an output signal from the calculator when the inputted displacement and the inputted positional information of said next inner chuck become close to each other, to retract said next inner chuck away from the related end face of the timber; and repeating like steps as above until only the innermost chuck remains gripping the timber.

7. The method according to claim 1, wherein the outermost chuck, the next inner chuck and any further intermediate chuck at one end face of the timber are caused to retract after the outermost chuck, the next inner chuck and any further intermediate chuck at the other end face of the timber have retracted, respectively.

8. The method according to claim 1, wherein said chucks are successively retracted away from the related end face of the timber as the cutting knife advances radially inwards of the timber towards the outer periphery of the respective chucks.

9. An apparatus for rotary-cutting a timber comprising:

a pair of first and second opposite chucking pawl means which are in a spaced, confronting relationship with respect to an axis of rotation of the timber;

means for moving the first and second chucking pawl means toward each other to grip therebetween the timber on said axis of rotation and away from each other to release the gripped timber;

means for rotating the first and second chucking pawl means to rotate the timber gripped between the chucking pawl means around the axis of rotation;

cutting knife means for cutting the timber being rotated; and means for advancing the knife means against the timber being rotated to rotary-cut the timber from its outer periphery radially inwards so as to peel off a veneer from an outer peripheral portion of the timber;

said apparatus further comprising:

a plurality of chucks with pawls, constituting each of said first and second chucking pawl means, said chucks including a radially outermost chuck at maximum distance from said axis of rotation, a radially innermost chuck at a minimum distance from said axis of rotation and at least one intermediate chuck between said outermost chuck and said innermost chuck, said chucks all being axially displaceable independently from each other;

displacing means connected to said chucks, respectively, for displacing the chucks towards and away from the timber independently; and means for operating the displacing means to retract the related chuck away from the timber when the knife means advances to a radial position of the timber close to the outer periphery of the related chuck.

10. The apparatus according to claim 9, wherein said chucks are arranged in a concentric manner.

11. The apparatus according to claim 9, wherein said chucks are arranged in parallel.

12. The apparatus according to claim 9, wherein said chucks are arranged spirally when seen in the direction of said axis of rotation.

13. The apparatus according to claim 9, wherein said displacing means comprises:

a plurality of spindles concentrically disposed in a mutually slidable manner around said axis of rotation and having said chucks fixed to front ends thereof, respectively; and drive means connected to rear ends of said spindles, respectively, so as to shift the spindles independently along said axis of rotation toward and away from the related end face of the timber.

14. The apparatus according to claim 13, wherein said spindles have the same axial length and are coextensive.

15. The apparatus according to claim 13, wherein said spindles have different axial lengths which increase for spindles closer to said axis of rotation.

16. The apparatus according to claim 15, wherein said drive means are disposed at axially different locations depending on the different axial lengths of the spindles.

17. The apparatus according to claim 13, wherein said drive means are fluid operated cylinders.

18. The apparatus according to claim 9, wherein said displacing means comprises:

a plurality of spindles disposed in parallel in an axially slidable manner and having said chucks fixed to front ends thereof, respectively; and drive means connected to rear ends of said spindles, respectively, for shifting the spindles independently along the axis of rotation toward and away from the related end face of the timber.

19. The apparatus according to claim 18, wherein said spindles have the same axial length and are coextensive.

20. The apparatus according to claim 18, further comprising a columnar block having axial holes for slidably accommodating said spindles, respectively.

21. The apparatus according to claim 18, wherein said drive means are fluid-operated cylinders.

22. The apparatus according to claim 9, wherein said displacing means comprises:

a single spindle disposed slidably along and on the axis of rotation and having an innermost one of said chucks fixed to a front end thereof, said spindle having a front supporting shaft;

annular sliding members fitted concentrically around said supporting shaft so as to be axially displaceable relative to each other and the supporting shaft;

drive means connected to the spindle so as to shift the spindle toward and away from the related end face of the timber; and further drive means connected to rear ends of said sliding members, respectively, for shifting the sliding members independently toward and away from the related end face of the timber.

23. The apparatus according to claim 22, wherein said further drive means is disposed around said supporting shaft.

24. The apparatus according to claim 23, wherein said further drive means include concentric drive members.

25. The apparatus according to claim 22, wherein said supporting shaft has a reduced diameter relative to the remaining portion of the spindle.

26. The apparatus according to claim 22, wherein all of said drive means are fluid-operated cylinders.

27. The apparatus according to claim 9, wherein said means for operating the displacing means comprises:

means for detecting the advancing displacement of the cutting knife means relative to the axis of rotation of the timber and for outputting a detection signal;

means for providing positional information of the radially outer periphery of the current outer chuck engaging the timber and for outputting a positional information signal;

calculator means responsive to said detection signal and said positional information signal for issuing an output signal when these signals indicate that the displacement and the positional information are close to each other, to retract said current outer chuck.

28. The apparatus according to claim 27, wherein said detecting means comprises a photoelectrical linear displacement detector.

29. The apparatus according to claim 27, wherein said detecting means comprises a magnetic linear displacement detector.

30. The apparatus according to claim 27, wherein said detecting means Comprises an encoder for converting rotational displacement into a linear displacement.

31. The apparatus according to claim 27, wherein said detecting means comprises a detecting switch for detecting linear displacement.

32. The apparatus according to claim 9, wherein said displacing means is operated to retract said chucks successively away from the related end face of the timber as the cutting knife means advances radially inwards of the timber towards the outer periphery of the respective chucks.

* * * * *